US009482991B2

(12) United States Patent
Kubo et al.

(10) Patent No.: US 9,482,991 B2
(45) Date of Patent: Nov. 1, 2016

(54) IMAGE FORMING APPARATUS FOR TRANSPORTING COLLECTED TONER AND NEW TONER WITH REDUCED CLOGGING

(71) Applicant: FUJI XEROX CO., LTD., Tokyo (JP)

(72) Inventors: Ryota Kubo, Kanagawa (JP); Kiyotoshi Kaneyama, Kanagawa (JP); Kuniaki Tanaka, Kanagawa (JP); Yoshinobu Kariya, Kanagawa (JP); Hideaki Ozawa, Kanagawa (JP); Yasutomo Ishii, Kanagawa (JP); Yuki Sekura, Kanagawa (JP); Tatsuya Soga, Kanagawa (JP); Shintaro Hattori, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/717,525

(22) Filed: May 20, 2015

(65) Prior Publication Data

US 2016/0116863 A1 Apr. 28, 2016

(30) Foreign Application Priority Data

Oct. 28, 2014 (JP) ..... 2014-218880

(51) Int. Cl.

| | |
|---|---|
| ***G03G 21/10*** | (2006.01) |
| ***G03G 15/08*** | (2006.01) |
| ***G03G 21/12*** | (2006.01) |

(52) U.S. Cl.

CPC ..... *G03G 15/0891* (2013.01); *G03G 15/0865* (2013.01); *G03G 21/105* (2013.01); *G03G 21/12* (2013.01)

(58) Field of Classification Search

CPC ..... G03G 21/10; G03G 21/105; G03G 15/0891; G03G 15/0865; G03G 21/12

USPC ..... 399/359, 254, 255

See application file for complete search history.

(56) References Cited

U.S. PATENT DOCUMENTS 5,734,957 A * 3/1998 Ogawa ..... G03G 21/105 399/255

5,878,317 A 3/1999 Masuda et al.

(Continued)

FOREIGN PATENT DOCUMENTS

| | | | |
|---|---|---|---|
| JP | 04-107585 | A * | 4/1992 |
| JP | 3537293 | B2 | 6/2004 |
| JP | 3565709 | B2 | 9/2004 |
| JP | 2006-106220 | A | 4/2006 |
| JP | 2007-178919 | A | 7/2007 |
| JP | 2012-103448 | A | 5/2012 |
| JP | 2013-105113 | A | 5/2013 |

OTHER PUBLICATIONS

Machine translation of JP 04-107585 A (with publication date of Apr. 9, 1992) printed on Mar. 15, 2016.*

*Primary Examiner* — Sophia S Chen

(74) *Attorney, Agent, or Firm* — Sughrue Mion, PLLC

(57) ABSTRACT

An image forming apparatus includes an image holding body, a developing device, a transfer device, a collection device, a container, and a transport member. The image holding body includes a surface on which a latent image is formed. The developing device develops the latent image into a visual image with developer. The transfer device transfers the visual image onto a transfer medium. The collection device collects the developer remaining on the surface of the image holding body after the visual image has been transferred. The container contains new developer supplied to the developing device. The image forming apparatus has a channel that has a first sub-channel and a second sub-channel. The developer flows into the first sub-channel from one of the collection device and the container and the second sub-channel from the other of the collection device and the container.

11 Claims, 14 Drawing Sheets

(56) References Cited

U.S. PATENT DOCUMENTS

| | | | | |
|---|---|---|---|---|
| 6,085,062 | A | 7/2000 | Mizuishi et al. | |
| 7,957,677 | B2 | 6/2011 | Miyata | |
| 8,559,863 | B2 * | 10/2013 | Gonda | G03G 15/0887 399/359 |
| 8,644,738 | B2 | 2/2014 | Takashima | |
| 8,897,677 | B2 | 11/2014 | Takashima | |
| 2001/0022905 | A1 * | 9/2001 | Kosuge | G03G 15/0891 399/359 |
| 2005/0232669 | A1 * | 10/2005 | Ishikawa | G03G 21/105 399/359 |
| 2006/0216086 | A1 * | 9/2006 | Yuasa | G03G 21/105 399/359 |

* cited by examiner

IMAGE FORMING APPARATUS FOR TRANSPORTING COLLECTED TONER AND NEW TONER WITH REDUCED CLOGGING

CROSS-REFERENCE TO RELATED APPLICATIONS

This application is based on and claims priority under 35 USC 119 from Japanese Patent Application No. 2014-218880 filed Oct. 28, 2014.

BACKGROUND (i) Technical Field

The present invention relates to an image forming apparatus.

(ii) Related Art

In some related art, developer is reused by collecting the developer from an image holding body and returning the developer to a developing device.

SUMMARY

According to an aspect of the present invention, an image forming apparatus includes an image holding body, a developing device, a transfer device, a collection device, a container, and a transport member. The image holding body includes a surface on which a latent image is formed. The developing device develops the latent image into a visual image with developer. The transfer device transfers the visual image onto a transfer medium. The collection device collects the developer remaining on the surface of the image holding body after the visual image has been transferred. The container contains new developer supplied to the developing device. The transport member includes a shaft and a transport blade supported by the shaft so that the transport blade has a helical shape. The image forming apparatus has a channel that has a first sub-channel connected to the developing device and a second sub-channel merged with the first sub-channel. The developer flows into the first sub-channel from one of the collection device and the container, and the developer flows into the second sub-channel from the other of the collection device and the container. The transport member is disposed in the second sub-channel so as to transport the developer, and part of the transport member extends into the first sub-channel.

BRIEF DESCRIPTION OF THE DRAWINGS

Exemplary embodiments of the present invention will be described in detail based on the following figures, wherein:

FIG. 8A is a view of the trapping member seen in an arrow VIII direction illustrated in FIG. 7 and FIG. 8B is an enlarged view of part of the trapping member.

FIG. 9A is an explanatory view of a state in which the process unit is attached, FIG. 9B includes explanatory views for explaining attachment and detachment of the process unit, FIG. 9C is a sectional view taken along line IXC-IXC illustrated in FIG. 9B, and FIG. 9D is a sectional view taken along line IXD-IXD illustrated in FIG. 9B;

FIG. 10A is an explanatory view of a state in which the process unit is attached, FIG. 10B includes explanatory views for explaining attachment and detachment of the process unit, and FIG. 10C is a view seen in an arrow XC direction illustrated in FIG. 10B;

FIG. 13A is a sectional view of a transport path, FIG. 13B is a sectional view taken along line XIIIB-XIIIB illustrated in FIG. 13A, and FIG. 13C is a view seen in an arrow XIIIC direction illustrated in FIG. 13A.

DETAILED DESCRIPTION

Figure 1:
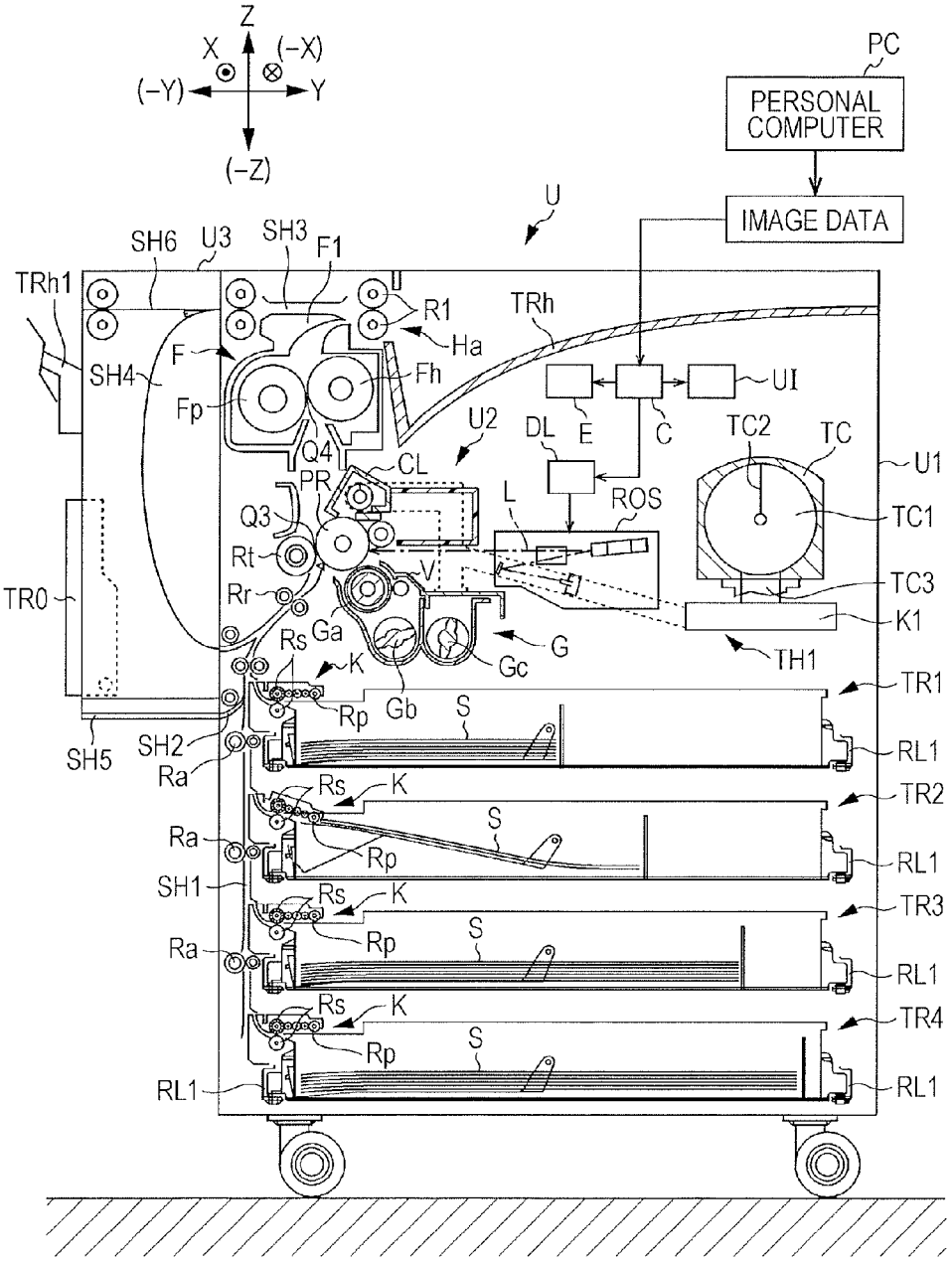
FIG. 1 is an overall explanatory view of an image forming apparatus according to a first exemplary embodiment.

Next, specific examples of exemplary embodiments of the present invention (referred to as exemplary embodiments hereafter) will be described with reference to the drawings. It is to be understood that the present invention is not limited to the following exemplary embodiments.

For ease of understanding of the description hereafter, the front-rear direction, the left-right direction, and the vertical direction in the drawings are respectively defined as the X direction, the Y direction, and the Z direction. Directions or sides indicated by arrows X, −X, Y, −Y, Z, and −Z are respectively indicate the front, rear, right, left, upper, and lower directions or sides.

Also, circles marked with dots therein and circles marked with "x"s therein illustrated in the pages of the drawings respectively indicate arrows extending from the back side to the front side of the pages and arrows extending from the front side to the back side of the pages.

It is noted that, in the following description with reference to the drawings, elements other than those required for the description may be omitted from the drawings as appropriate for ease of understanding.

First Exemplary Embodiment

FIG. 1 is an overall explanatory view of an image forming apparatus according to a first exemplary embodiment.

In FIG. 1, a printer U that serves as an example of an image forming apparatus according to the first exemplary embodiment and also serves an example of an installed apparatus includes a printer body U1 that serves as an example of an apparatus body. A first output tray TRh that serves as an example of a first medium output unit is provided in an upper surface of the printer body U1. An operation unit UI is provided in the upper surface of a right portion of the printer body U1. The operation unit UI includes components such as a display (not illustrated). The operation unit UI allows a user to perform an input operation therewith.

A personal computer PC that serves as an example of an image information transmitting device is electrically connected to the printer U according to the first exemplary embodiment directly or via a network.

The printer U includes a controller C that serves as an example of a controller. The controller C is capable of receiving electrical signals such as image information and a control signal transmitted from the personal computer PC. The controller C is also capable of outputting control signals to the operation unit UI and a power source circuit E. Furthermore, the controller C is electrically connected to a writing circuit DL.

The writing circuit DL outputs a driving signal to a light exposure device ROS in accordance with information input thereto. The light exposure device ROS serves as an example of a writing device. The light exposure device ROS is capable of outputting a laser beam L in accordance with a signal input thereto. The laser beam L serves as an example of writing light.

Figure 2:
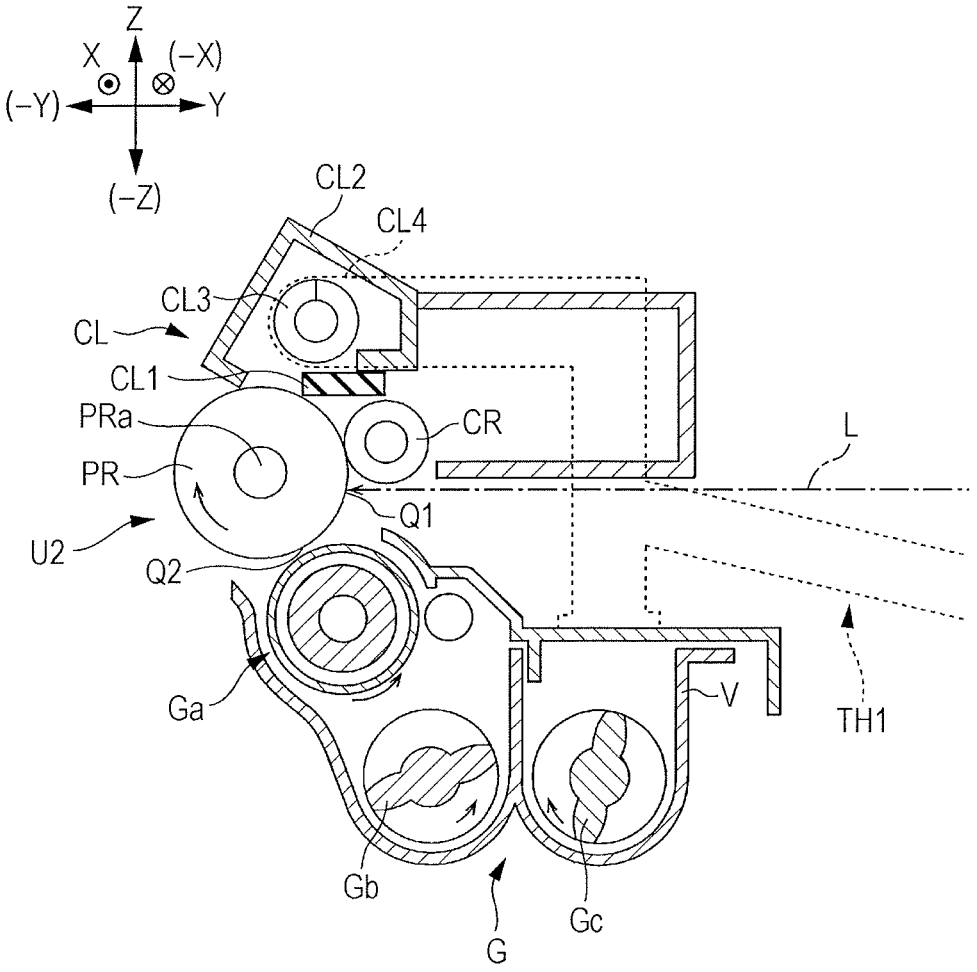
FIG. 2 is an enlarged view of part of a toner image forming device illustrated in FIG. 1.

FIG. 2 is an enlarged view of part of a toner image forming device illustrated in FIG. 1.

Referring to FIGS. 1 and 2, a photosensitive body PR that serves as an example of an image holding body is disposed to the left of the light exposure device ROS. The photosensitive body PR according to the first exemplary embodiment is supported such that the photosensitive body PR is rotatable about a rotational shaft PRa in an arrow direction. The photosensitive body PR has a writing region Q1 that is irradiated with the laser beam L.

A charging roller CR, a developing device G, and a photosensitive-body cleaner CL are arranged in a rotational direction of photosensitive body PR around the photosensitive body PR. The charging roller CR serves as an example of a charging member. The photosensitive-body cleaner CL serves as an example of a cleaning device for the image holding body.

In the printer U according to the first exemplary embodiment, the photosensitive body PR, the charging roller CR, the developing device G, and the photosensitive-body cleaner CL are integrated with one another to form a unit that is detachably attached. That is, the photosensitive body PR, the charging roller CR, the developing device G, and the photosensitive-body cleaner CL are included in a process unit U2 that is detachably attached to the printer body U1.

A charging voltage is applied from the power source circuit E to the charging roller CR.

The developing device G includes a developing container V therein. The developing container V contains toner that serves as an example of developer. A developing roller Ga that serves as an example of a developer holding body is rotatably supported in the developing container V. The developing roller Ga faces the photosensitive body PR in a developing region Q2.

Furthermore, a developing voltage is applied from a power source circuit E to the developing roller Ga. Augers Gb and Gc are rotatably supported in the developing container V. The augers Gb and Gc each serve as an example of a developer transport member.

Referring to FIGS. 1 and 2, one end of a replenishing path of a toner replenishing device TH1 is connected to the developing container V. The toner replenishing device TH1 that serves as an example of a developer replenishing device is secured to and supported by the printer U. The other end of the replenishing path of the toner replenishing device TH1 is connected to a discharge port TC3 of a toner cartridge TC that serves as an example of a container for developer.

The toner cartridge TC includes a cartridge body TC1 that serves as an example of a container body that contains the toner therein. A toner transport member TC2 that serves as an example of a developer transport member is rotatably supported in the cartridge body TC1. The toner cartridge TC is detachable from and attachable to the printer U by removing and inserting in the front-rear direction.

The toner image forming device that forms a toner image on the photosensitive body PR includes the components such as the photosensitive body PR, the charging roller CR, the light exposure device ROS, and the developing device G.

Referring to FIG. 1, sheet feed trays TR1 to TR4 are provided in a lower portion of the printer U. The sheet feed trays TR1 to TR4 each serve as an example of a medium containing unit. The sheet feed trays TR1 to TR4 contain recording sheets S. Each of the sheets S serves as an example of a medium.

In FIG. 1, rails RL1 are disposed on the left and right sides of each of the sheet feed trays TR1 to TR4. The rails RL1 each serve as an example of container guide member. Left and right end portions of the sheet feed trays TR1 to TR4 are movably supported by the rails RL1. Thus, each of the sheet feed trays TR1 to TR4 is supported by a corresponding pair of the left and right rails RL1 such that the each of the sheet feed trays TR1 to TR4 is capable of being drawn and retracted in the front-rear direction.

Referring to FIG. 1, a sheet feed device K is disposed to the left above each of the sheet feed trays TR1 to TR4. The sheet feed devices K each include a pickup roller Rp that serves as an example of a medium pickup member. A separation roller set Rs that serves as an example of a separation member is disposed to the left of the pickup roller Rp. The separation roller set Rs includes a feed roller and a retard roller. The feed roller serves as an example of a medium transport member. The retard roller serves as an example of medium parting member.

A sheet feed path SH1 that serves as an example of a medium transport path is disposed to the left of the sheet feed devices K. The sheet feed path SH1 extends upward. Plural transport rollers Ra are disposed along the sheet feed path SH1. Each of the transport rollers serves as an example of a medium transport member. A registration roller Rr that serves as an example of a medium transport timing adjustment member is disposed at an upper end of the sheet feed path SH1, which is a downstream end of the sheet feed path SH1.

Furthermore, a manual feed tray TR0 that serves as an example of a manual feed unit is attached on a left side portion of the printer U. A left end SH5 of a manual feed path SH2 that serves as an example of a manual feed transport path is connected to a right portion of the manual feed tray TR0. A right end of the manual feed path SH2 is connected to the sheet feed path SH1.

Referring to FIG. 1, a transfer roller Rt that serves as an example of a transfer device is disposed above the registration roller Rr. The transfer roller Rt faces and is in contact with the photosensitive body PR in a transfer region Q3. Thus, the transfer roller Rt according to the first exemplary embodiment is rotated by rotation of the photosensitive body PR. A transfer voltage is applied from the power source circuit E to the transfer roller Rt.

The photosensitive-body cleaner CL is disposed on the downstream of the transfer roller Rt in the rotational direction of the photosensitive body PR. The photosensitive-body cleaner CL includes a cleaning blade CL1 that serves as an example of a cleaning member. The cleaning blade CL1 has a plate shape. One end portion of the cleaning blade CL1 is in contact with the photosensitive body PR.

A cleaner container CL2 that serves as an example of a cleaning container is disposed above the cleaning blade CL1. The cleaning blade CL1 is supported by the cleaner container CL2. A space capable of containing the developer is formed in the cleaner container CL2. A collection auger CL3 that serves as an example of a developer transport member is rotatably supported in the cleaner container CL2.

Furthermore, a collection path CL4 that serves as a developer transport path is supported in the cleaner container CL2. The collection path CL4 extends from the photosensitive-body cleaner CL to the developing device G.

Referring to FIG. 1, a fixing device F is supported above the transfer roller Rt. The fixing device F includes a heating roller Fh and a pressure roller Fp. The heating roller Fh serves as an example of a heat fixing member. The pressure roller Fp serves as an example of a pressure fixing member. The heating roller Fh and the pressure roller Fp are in contact with each other in a fixing region Q4. A drive is transferred from a drive source (not illustrated) to the heating roller Fh, thereby rotating the heating roller Fh. Also, power used to heat a heater (not illustrated) is supplied from the power source circuit E to the heating roller Fh.

An image recording section U2+Rt+F that records an image on the sheet S includes the process unit U2, the transfer roller Rt, and the fixing device F.

A sheet guide F1 that serves as an example of a medium guide unit is formed on the upper portion of the fixing device F. Sheet output rollers R1 are disposed to the right of the sheet guide F1. The sheet output rollers R1 each serve as an example of a medium output member. A medium output opening Ha is formed to the right of the sheet output rollers R1. The first output tray TRh is disposed below the medium output opening Ha.

Referring to FIG. 1, a connection path SH3 that serves as an example of a medium transport path is disposed at a position above the fixing device F and to the left of the sheet output rollers R1. The connection path SH3 extends leftward from the output opening Ha.

An inversion unit U3 that serves as an example of a medium inversion device is supported above the manual feed tray TR0 on the left side surface of the printer body U1. An inversion path SH4 that serves as an example of a medium transport path is formed in the inversion unit U3. An upper end of the inversion path SH4 is connected to a left end of the connection path SH3. A lower end of the inversion path SH4 is merged with the sheet feed path SH1 on the upstream of the registration roller Rr.

Furthermore, a second output path SH6 that serves as an example of a medium transport path is formed in an upper portion of the inversion unit U3. A right end of the second output path SH6 is connected to the connection path SH3. The second output path SH6 branches from the inversion path SH4. A left end of the second output path SH6 extends to a left side surface of the inversion unit U3. A face up tray TRh1 that serves as an example of a second output unit is supported on the left side surface of the inversion unit U3. Thus, the sheet S having passed through the second output path SH6 may be output to the face up tray TRh1.

Functions of the Image Forming Apparatus

Image information transmitted from the personal computer PC is input to the controller C of the printer U according to the first exemplary embodiment having the above-described structure. The controller C converts the image information input thereto into latent image forming information at preset timing and outputs the latent image forming information to the writing circuit DL. The light exposure device ROS outputs the laser beam L in accordance with a signal received by the writing circuit DL. The controller C controls operations of the operation unit UI, the writing circuit DL, the power source circuit E, and so forth.

Referring to FIGS. 1 and 2, a surface of the photosensitive body PR is charged by the charging roller CR to which the charging voltage is applied. The surface of the photosensitive body PR charged by the charging roller CR is irradiated with and scanned by the laser beam L from the light exposure device ROS in the writing region Q1, thereby an electrostatic latent image is formed. The surface of the photosensitive body PR on which the electrostatic latent image has been formed sequentially passes through the developing region Q2 and the transfer region Q3.

The developing roller Ga faces the photosensitive body PR in the developing region Q2. The developing roller Ga is rotated while holding developer in the developing container V on the surface of the developing roller Ga. Thus, the electrostatic latent image on the surface of the photosensitive body PR is developed into a toner image by the toner held on the surface of the developing roller Ga. The toner image serves as an example of a visual image. The developer in the developing container V is circulated while being agitated by the augers Gb and Gc.

As the development is performed with the developing roller Ga, the developer in the developing container V is consumed. As the developer in the developing container V is consumed, the developing container V is replenished with the developer from the toner cartridge TC. That is, in accordance with the amount of consumed developer, the tone transport member TC2 is rotated, so that the toner in the cartridge body TC1 is transported to the discharge port TC3. The toner discharged through the discharge port TC3 is transported to the developing container V by a replenishing transport member (not illustrated) in the replenishing path of the cartridge toner replenishing device TH1.

The sheets S on which images are to be recorded are contained in the sheet feed trays TR1 to TR4. The sheets S contained in the sheet feed trays TR1 to TR4 are picked up by the pickup rollers Rp of the sheet feed devices K. The separation roller sets Rs each separate one sheet after another from the sheets S having been picked up by a corresponding one of the pickup rollers Rp. Each of the sheets S having been separated by the separation roller sets Rs is fed into the sheet feed path SH1. The sheet S is transported toward the registration roller Rr by the transport rollers Ra through the sheet feed path SH1.

The sheet S fed from the manual feed tray TR0 is transported to the registration roller Rr through the manual feed path SH2. The sheet S having been transported to the registration roller Rr is transported to the transfer region Q3 by the registration roller Rr at timing adjusted to timing at which the toner image on the photosensitive body PR is moved to the transfer region Q3.

The toner image on the surface of the photosensitive body PR is transferred onto the sheet S that is passing through the transfer region Q3 by the transfer roller Rt to which the transfer voltage is applied in the transfer region Q3.

Referring to FIG. 2, the toner attracted to the surface of the photosensitive body PR having passed through the transfer region Q3 is removed by the cleaning blade CL1. Thus, the photosensitive body PR is cleaned. The toner removed by the cleaning blade CL1 is collected in the cleaner container CL2. The toner collected in the cleaner container CL2 is transported by the collection auger CL3. The toner transported by the collection auger CL3 is returned into the developing container V through the collection path CL4. That is, the developer collected by the photosensitive-body cleaner CL is reused by the developing device G.

After the surface of the photosensitive body PR has been cleaned by the photosensitive-body cleaner CL, the photosensitive body PR is charged again by the charging roller CR.

The sheet S onto which the toner image has been transferred in the transfer region Q3 is transported to the fixing region Q4 of the fixing device F. At this time, the toner image on the sheet S has not been fixed.

The sheet S is interposed between the heating roller Fh and the pressure roller Fp in the fixing region Q4, so that the toner image is heat fixed.

The sheet S onto which the toner image has been fixed by the fixing device F is guided by the sheet guide F1 so as to be transported to the sheet output rollers R1. In the case where the sheet S is output to the first output tray TRh, the sheet S having fed to the sheet output rollers R1 is output to the first output tray TRh through the output opening Ha.

When duplex printing is performed, the sheet output rollers R1 are rotated in the reverse direction when a trailing end in a transport direction of the sheet S has passed through the sheet guide F1. At this time, the image has been recorded on a first side of this sheet S. Thus, the sheet S is transported into the inversion path SH4 through the connection path SH3. The sheet S having transported through the inversion path SH4 is transported in the inverted state to the registration roller Rr. Thus, the sheet S is transported from the registration roller Rr to the transfer region Q3 again, and an image is recorded in a second side of the sheet S.

When the sheet S is output to the face up tray TRh1, the sheet S transported through the connection path SH3 by the reverse rotation of the sheet output rollers R1 is transported into the second output path SH6. The sheet S having been transported through the second output path SH6 is output to the face up tray TRh1.

Description of the Process Unit U2, the Toner Cartridge TC, the Toner Replenishing Device TH1, and a Toner Transport Device TH2

Figure 3:
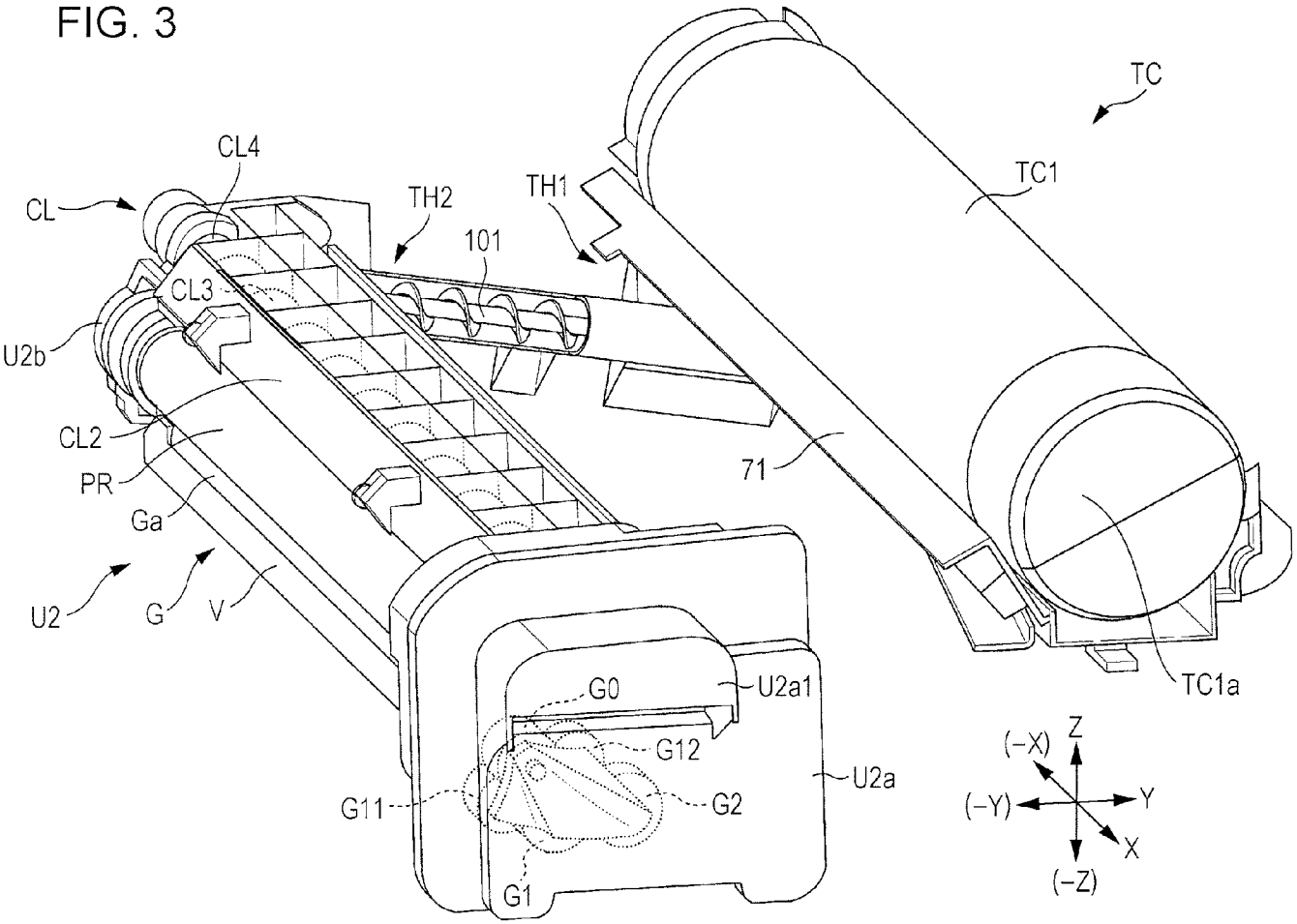
FIG. 3 is a perspective view of part of the image forming apparatus according to the first exemplary embodiment.

FIG. 3 is a perspective view of part of the image forming apparatus according to the first exemplary embodiment.

Figure 4:
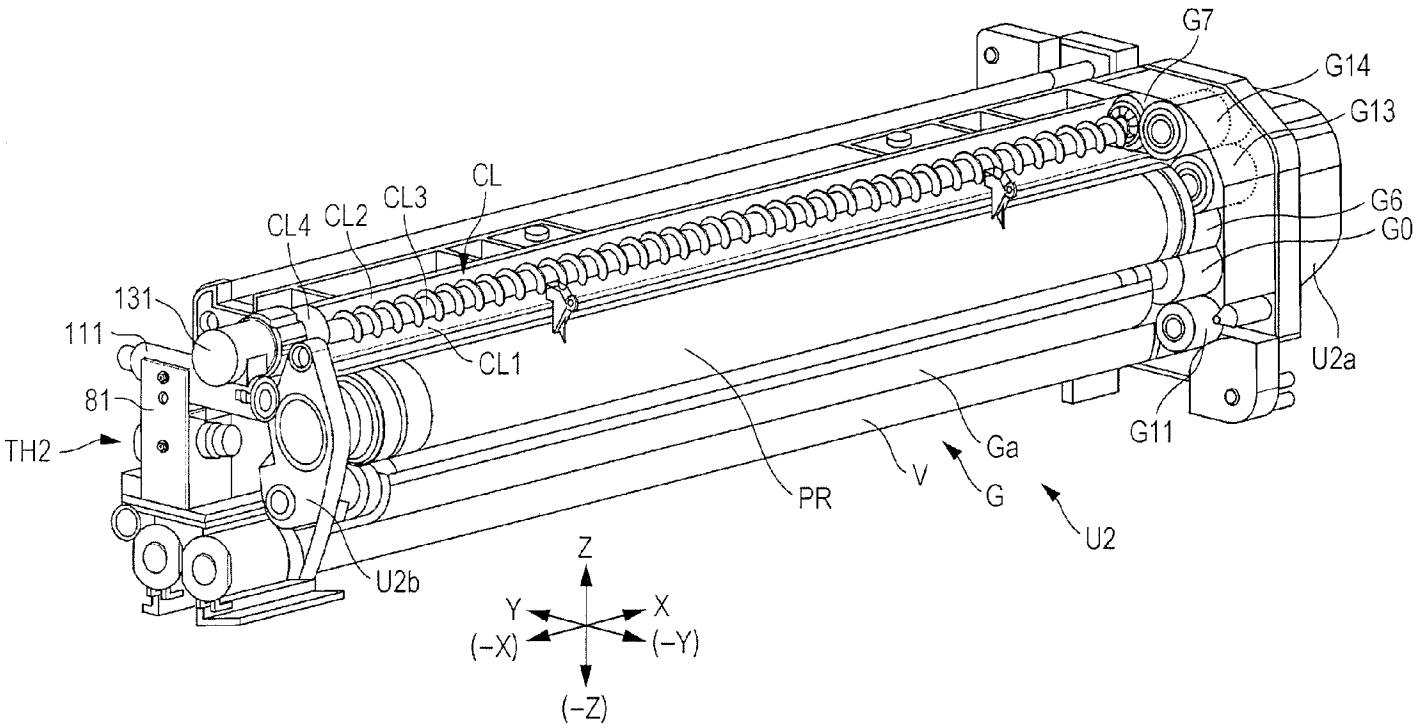
FIG. 4 is a perspective view of a process unit according to the first exemplary embodiment.

FIG. 4 is a perspective view of the process unit according to the first exemplary embodiment.

Referring to FIGS. 3 and 4, the process unit U2 according to the first exemplary embodiment includes a pair of front and rear frames U2*a* and U2*b*. The frames U2*a* and U2*b* each serve as an example of a frame body. The photosensitive body PR, the developing device G, the photosensitive-body cleaner CL, and so forth are supported by the frames U2*a* and U2*b*. A handle U2*a*1 is formed on the front frame U2*a*. The handle U2*a*1 projects forward and is bent downward. The process unit U2 according to the first exemplary embodiment is detachably supported by the printer body U1.

Detailed Description of the Developing Device G

Figure 5:
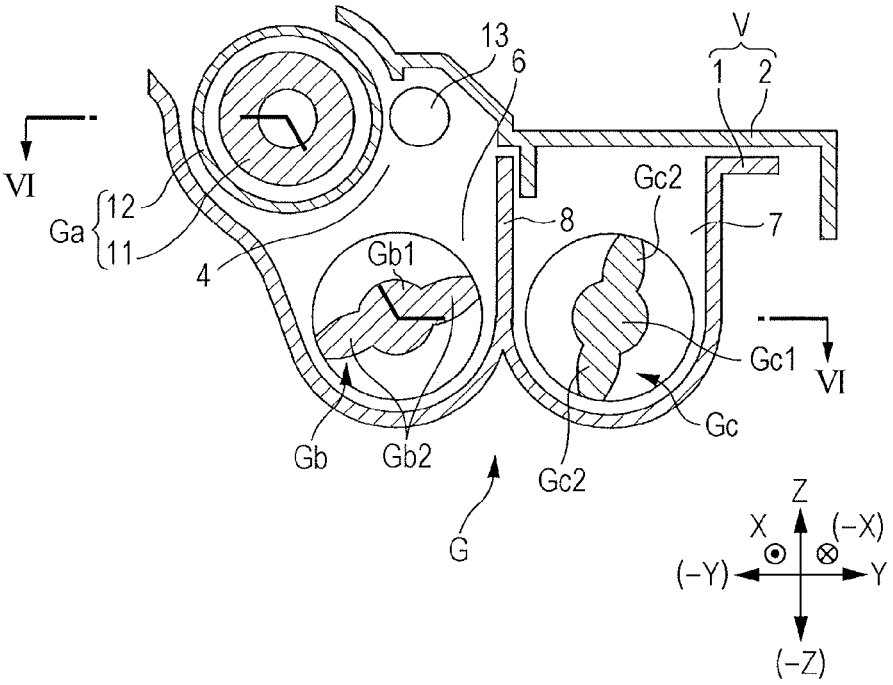
FIG. 5 is an explanatory view of a developing device according to the first exemplary embodiment illustrating an enlarged view of part of the structure illustrated in FIG. 2.

FIG. 5 is an explanatory view of the developing device according to the first exemplary embodiment illustrating an enlarged view of part of the structure illustrated in FIG. 2.

Figure 6:
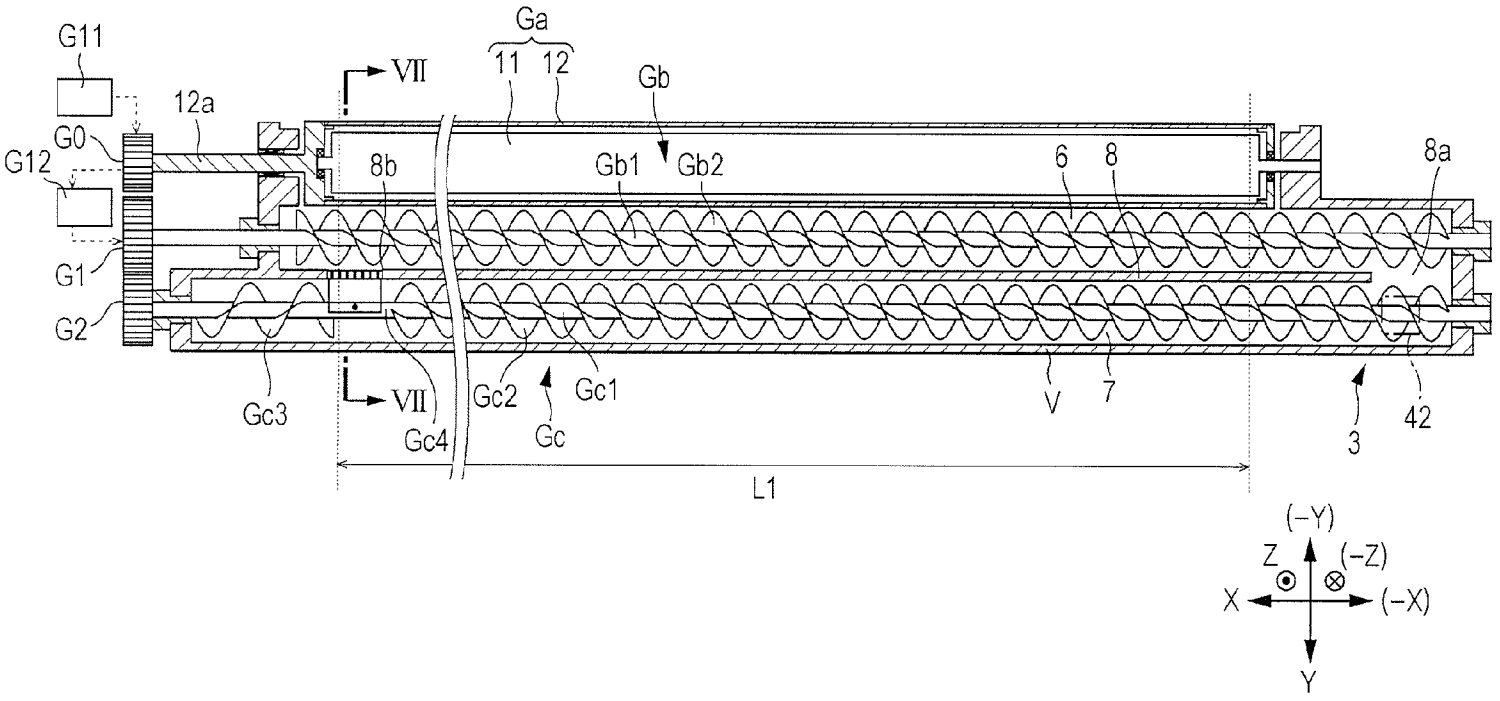
FIG. 6 is an explanatory view of the developing device according to the first exemplary embodiment illustrating a section taken along line VI-VI illustrated in FIG. 5.

FIG. 6 is an explanatory view of the developing device according to the first exemplary embodiment illustrating a section taken along line VI-VI illustrated in FIG. 5.

Referring to FIGS. 3 and 4, the developing device G is disposed below the photosensitive body PR.

Referring to FIGS. 5 and 6, the developing device G includes a developing container V. The developing container V contains the toner that serves as the example of the developer. The developing container V includes a container body 1 in a lower portion thereof. A container covering 2 that serves as a lid member is supported above the container body 1. The container covering 2 closes an upper surface of the container body 1. The container body 1 according to the first exemplary embodiment has a projection 3 that projects rearward from a lower portion of the container body 1. An upper surface of the projection 3 is also closed by the container covering 2.

Referring to FIG. 5, the container body 1 has a developing roller chamber 4 on an upper left portion therein. The developing roller chamber 4 serves as an example of a developer holding body container. A supply chamber 6 is formed to the right of the developing roller chamber 4 below the developing roller chamber 4. The supply chamber 6 serves as an example of a first container chamber. The supply chamber 6 is connected to the developing roller chamber 4. An agitating chamber 7 is formed to the right of the supply chamber 6 beside the supply chamber 6. The agitating chamber 7 serves as an example of a second container chamber. Referring to FIG. 6, according to the first exemplary embodiment, the lengths of the supply chamber 6 and the agitating chamber 7 in the front-rear direction are longer than the length of the developing roller chamber 4. In particular, the supply chamber 6 and the agitating chamber 7 extend rearward from the container body 1 to the inside of the projection 3. The supply chamber 6 and the agitating chamber 7 are partitioned by a partition 8 that serves as an example of a partitioning member. A rear connecting portion 8*a* that serves as an example of a first connecting portion is formed behind the partition 8. The rear connecting portion 8*a* connects the supply chamber 6 and the agitating chamber 7 to each other. The rear connecting portion 8*a* is disposed further to the rear side than a rear end of the developing roller chamber 4. That is, the rear connecting portion 8*a* is formed inside the projection 3. A front connecting portion 8*b* that serves as an example of a second connecting portion is formed in front of the partition 8. The front connecting portion 8*b* connects the supply chamber 6 and the agitating chamber 7 to each other. A circulating chamber 6+7 according to the first exemplary embodiment includes the supply chamber 6 and the agitating chamber 7.

A developing roller Ga that serves as the example of the developer holding body is contained in the developing roller chamber 4. An outer surface of the developing roller Ga faces the photosensitive body PR on the upper side. The developing roller Ga includes a magnet roller 11 that serves as an example of a magnet member. The magnet roller 11 is supported such that the magnet roller 11 is not rotatable relative to the developing container V. A developing sleeve 12 that serves as an example of a rotating body is disposed on an outer circumference of the magnet roller 11. The developing sleeve 12 is supported such that the developing sleeve 12 is rotatable relative to the developing container V.

A shaft 12*a* that extends forward is supported at a front end of the developing sleeve 12. A gear G0 that serves as an example of a drive transmitting member is supported by the transmitting shaft 12*a*.

A trimmer 13 that serves as an example of a layer thickness regulating member is disposed on the right side of the developing roller chamber 4. The trimmer 13 according to the first exemplary embodiment has a columnar shape extending in the front-rear direction. The trimmer 13 is supported such that the trimmer 13 is spaced apart from the developing sleeve 12 by a preset gap and the trimmer 13 is not rotatable.

The supply auger Gb that serves as an example of a first transport member of the developing device G is disposed in the supply chamber 6. The supply auger Gb includes a rotational shaft Gb1 that extends in the front-rear direction. A double-helix transport blade Gb2 is supported on an outer circumference of the rotational shaft Gb1. The double-helix transport blade Gb2 serves an example of a helical transport blade. A gear G1 that serves as an example of a drive transmitting member is supported at a front end of the rotational shaft Gb1.

The agitating auger Gc that serves as an example of a second transport member of the developing device G is disposed in the agitating chamber 7. The agitating auger Gc includes a rotational shaft Gc1 that extends in the front-rear direction. Similarly to the supply auger Gb, double-helix transport blade Gc2 is supported at a portion of the rotational shaft Gc1 behind the front connecting portion 8*b*. Furthermore, a reverse transport blade Gc3 is supported at a portion of the rotational shaft Gc1 in front of the front connecting portion 8*b*. The winding direction of the reverse transport blade Gc3 is opposite to that of the double-helix transport blade Gc2, and the number of turns of the helical blade of the reverse transport blade Gc3 is less than that of the double-helix transport blade Gc2. Furthermore, the rotational shaft Gc1 has a wiping-member support portion Gc4 at a portion thereof facing the front connecting portion 8*b*.

Figure 7:
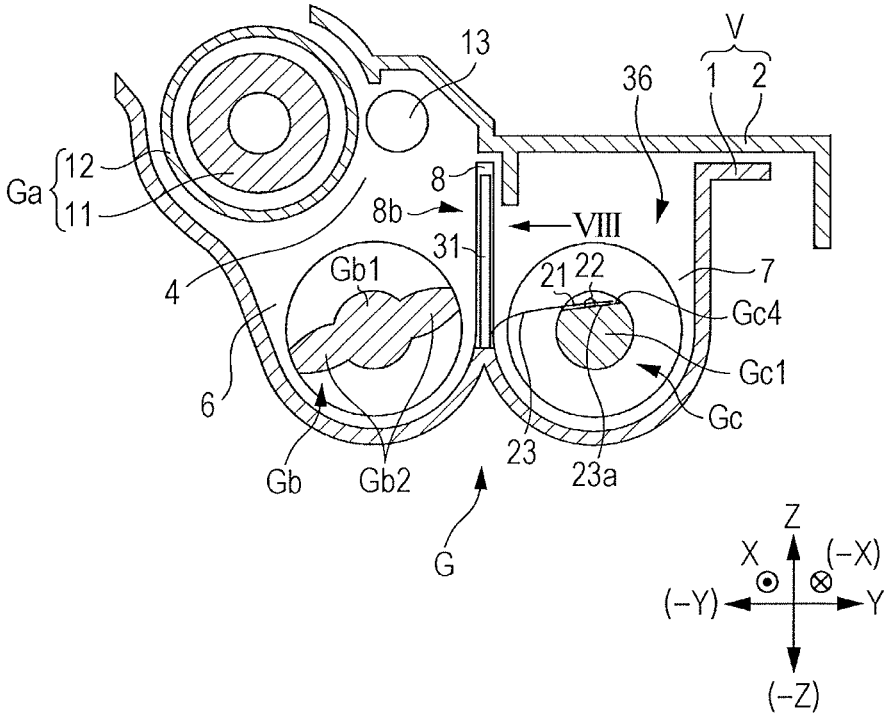
FIG. 7 is an explanatory view of the developing device according to the first exemplary embodiment illustrating a section taken along line VII-VII illustrated in FIG. 6.

FIG. 7 is an explanatory view of the developing device according to the first exemplary embodiment illustrating a section taken along line VII-VII illustrated in FIG. 6.

Referring to FIG. 7, the wiping-member support portion Gc4 has a shape formed by cutting part of the section of the shaft by a plane, that is, a D-cut shape. A bar-shaped projection 21 that projects in the radial direction is supported at a planar portion of the D-cut shape. A retainer 22 is formed at a tip end of the projection 21. The diameter of the retainer 22 is larger than that of a base end portion. A wiping film 23 that serves as an example of a wiping member and an example of a cleaning member is supported by the projection 21. The wiping film 23 has a thin plate shape having flexibility. The wiping film 23 according to the first exemplary embodiment has a hole 23*a* having a diameter smaller than that of the retainer 22. The projection 21 and the retainer 22 are inserted into the hole 23*a*, so that the wiping film 23 is supported by the wiping-member support portion Gc4. According to the first exemplary embodiment, the length of the wiping film 23 in the front-rear direction corresponds to the length of the front connecting portion 8*b*. Furthermore, the length of the wiping film 23 in the radial direction is longer than the distance between the rotational shaft Gc1 to the front connecting portion 8*b*. The wiping film 23 according to the first exemplary embodiment is formed of polyethylene terephthalate (PET).

Figure 8A:
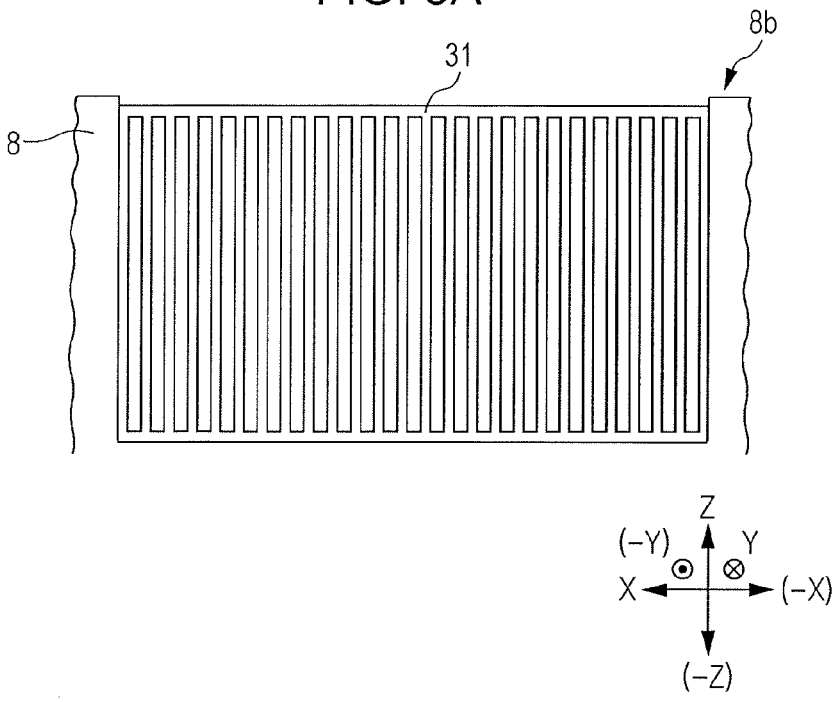
FIGS. 8A and 8B are explanatory views of a trapping member according to the first exemplary embodiment, and out of FIGS. 8A and 8B.
Figure 8B:
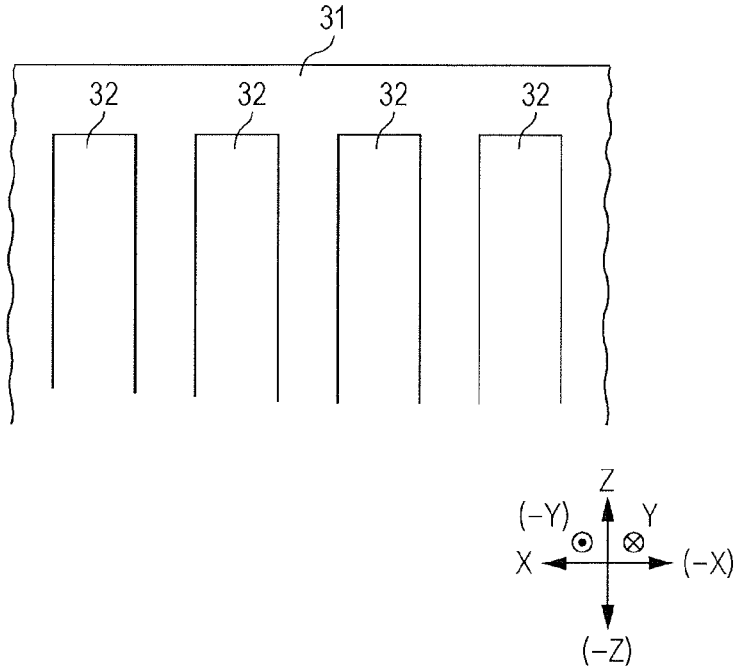

FIGS. 8A and 8B are explanatory views of a trapping member according to the first exemplary embodiment. FIG. 8A is a view of the trapping member seen in an arrow VIII direction illustrated in FIG. 7. FIG. 8B is an enlarged view of part of the trapping member.

Referring to FIGS. 6 to 8B, a filter 31 serving as an example of the trapping member is supported at the front connecting portion 8*b*. The filter 31 has plural slits 32. The slits 32 each serve as an example of an opening. The structures of the wiping film 23 and the filter 31 are not limited to those of the first exemplary embodiment, and known related-art structures may be applied to the structures of the wiping film 23 and the filter 31. Thus, detailed description of the wiping film 23 and the filter 31 is omitted.

A foreign-matter trapping mechanism 36 according to the first exemplary embodiment includes the rotational shaft Gc1 of the agitating auger Gc, the wiping film 23, and the filter 31.

Figure 9A:
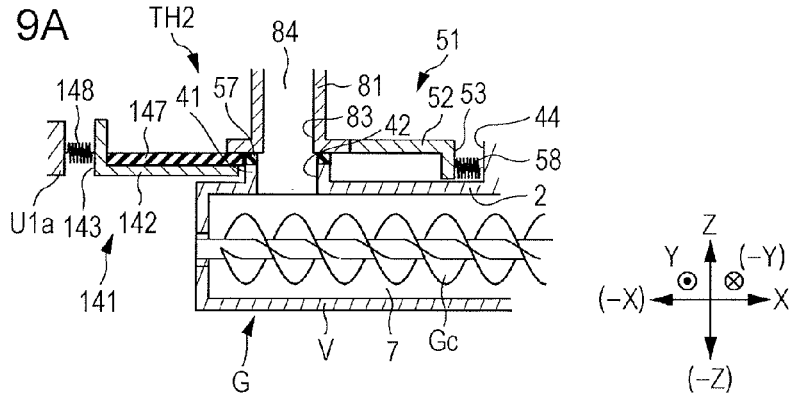
FIGS. 9A to 9D are explanatory views of a connecting mechanism that connects a channel and the developing device to each other according to the first exemplary embodiment, and out of FIGS. 9A to 9D.
Figure 9B:
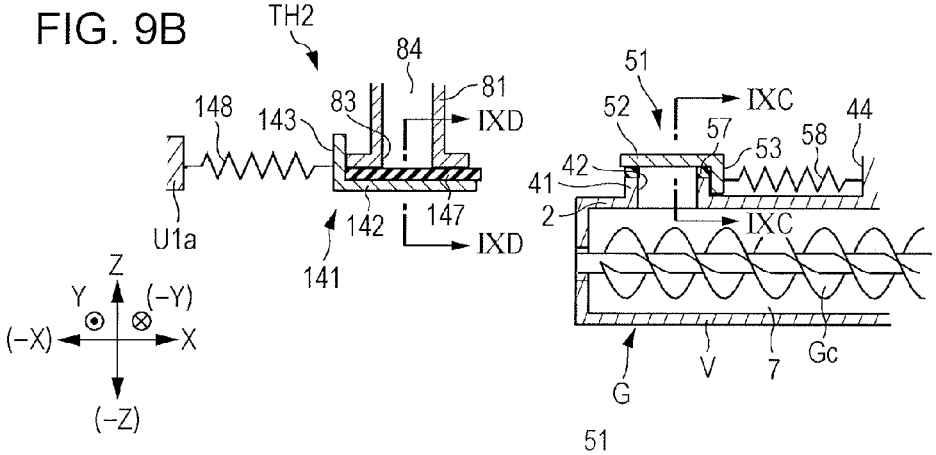
Figure 9C:
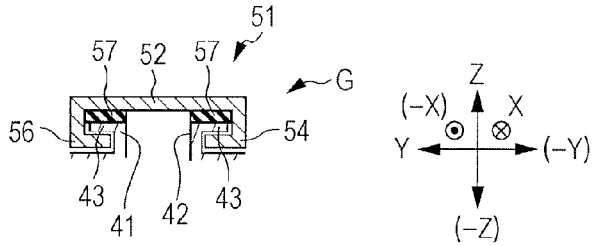
Figure 9D:
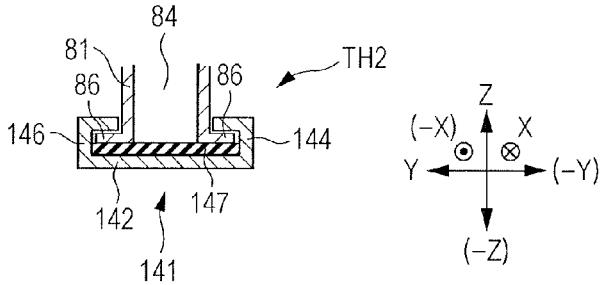

FIGS. 9A to 9D are explanatory views of a connecting mechanism that connects a channel and the developing device to each other according to the first exemplary embodiment. FIG. 9A is an explanatory view of a state in which the process unit is attached. FIG. 9B includes explanatory views for explaining attachment and detachment of the process unit. FIG. 9C is a sectional view taken along line IXC-IXC illustrated in FIG. 9B. FIG. 9D is a sectional view taken along line IXD-IXD illustrated in FIG. 9B.

Referring to FIGS. 6 and 9A to 9D, a cylindrical portion 41 that serves as an example of an opening-and-closing-member support portion and that projects upward corresponding to a rear end portion of the agitating chamber 7 is supported at the container covering 2 of the developing device G. The cylindrical portion 41 has a replenishing port 42 that serves as an example of a developer inlet. The replenishing port 42 vertically penetrates through the container covering 2. Referring to FIG. 9C, guide portions 43 are formed at left and right ends of the tip of the cylindrical portion 41. The guide portions 43 each serve as an example of a guide portion. The guide portions 43 project outward from the cylinder and extend in the front-rear direction. A spring support portion 44 that serves as an example of an urging-member support portion on the developing device side is formed in front of the cylindrical portion 41.

Referring to FIGS. 9A and 9B, a shutter 51 that serves as an example of an opening and closing member is supported at the cylindrical portion 41. The shutter 51 includes a plate-shaped body portion 52. A spring support portion 53 that serves as an example of an urging-member support portion on the opening-and-closing-member side and that extends downward is formed at a front end of the body portion 52. Furthermore, referring to FIG. 9C, portions to be guided 54 and 56 are formed on left and right ends of the body portion 52. The portions to be guided 54 and 56 each serve as an example of a guided portion and each have a shape extending downward and bent inward in the left-right direction. The portions to be guided 54 and 56 are guided while being engaged with the guide portions 43. Thus, the shutter 51 is moved in the front-rear direction along the guide portions 43. That is, the shutter 51 according to the first exemplary embodiment is supported such that the shutter 51 is movable between an open position illustrated in FIG. 9A and a closed position illustrated in FIG. 9B. The shutter 51 is moved forward from the replenishing port 42 to the open position so as to open the replenishing port 42. The shutter 51 at the closed position closes the replenishing port 42.

A seal 57 that serves as an example of an anti-leakage member is supported at an upper surface of the cylindrical portion 41. The seal 57 tightly closes a gap between the shutter 51 and the replenishing port 42 when the shutter 51 is held at the closed position.

A spring 58 that serves as an example of an urging member is supported between the spring support portion 53 of the shutter 51 and the spring support portion 44 on the developing container V side. The spring 58 urges the shutter 51 rearward. That is, the spring 58 urges the shutter 51 so as to hold the shutter 51 at the closed position.

Figure 10A:
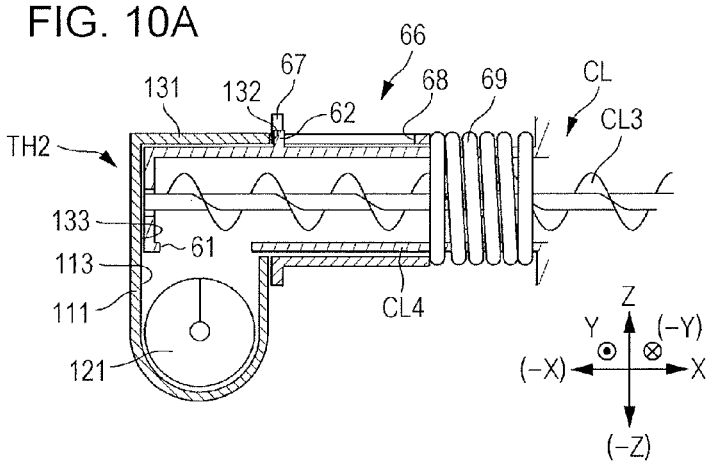
FIGS. 10A to 10C are explanatory views of a connecting mechanism that connects the channel and a collection device to each other according to the first exemplary embodiment, and out of FIGS. 10A to 10C.
Figure 10B:
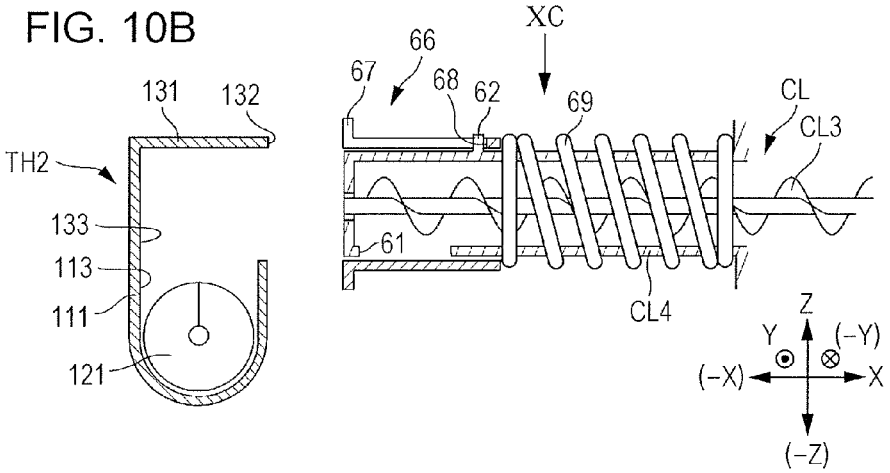
Figure 10C:
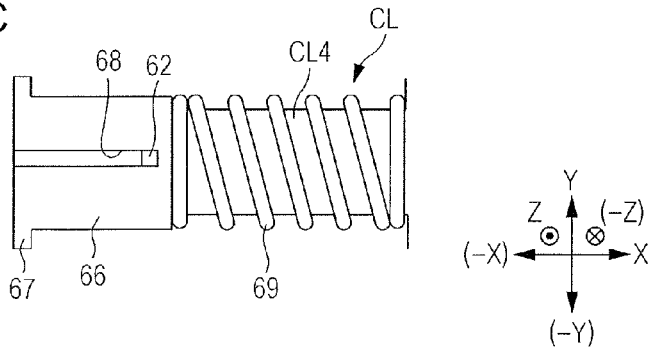

Description of the Photosensitive Body PR, the Charging Roller CR, and the Photosensitive-Body Cleaner CL FIGS. 10A to 10C are explanatory views of a connecting mechanism that connects the channel and a collection device to each other according to the first exemplary embodiment. FIG. 10A is an explanatory view of a state in which the process unit is attached. FIG. 10B includes explanatory views for explaining attachment and detachment of the process unit. FIG. 10C is a view seen in an arrow XC direction illustrated in FIG. 10B.

Referring back to FIGS. 2 and 4, the photosensitive body PR is rotatably supported by the frame U2*a* of the process unit U2 corresponding to an upper portion of the developing roller Ga of the developing device G. A gear G6 is supported at a front end portion of the photosensitive body PR. The charging roller CR is supported on the right side of the photosensitive body PR. Furthermore, the photosensitive-body cleaner CL that serves as an example of a collection device is supported on the upper side of the photosensitive body PR.

Referring to FIGS. 10A to 10C, the collection path CL4 is supported at a rear end of the cleaner container CL2 of the photosensitive-body cleaner CL according to the first exemplary embodiment. The collection path CL4 according to the first exemplary embodiment has a cylindrical shape that extends rearward. An outlet 61 is formed at a rear end portion of the collection path CL4. The developer flows from the inside to the outside of the collection path CL4 through the outlet 61. The outlet 61 is open at the bottom. A regulating portion 62 that projects upward is supported on the upper side of the collection path CL4.

A shutter 66 that serves as an example of an outlet opening and closing member is supported at the collection path CL4 corresponding to the position of the outlet 61. The shutter 66 has a cylindrical shape. An inner diameter of the shutter 66 is greater than an outer diameter of the collection path CL4. A flange portion 67 that serves as an example of a contact portion and that radially outwardly projects is formed at a rear end portion of the shutter 66. The shutter 66 also has a groove-shaped portion to be guided 68 that extends from the rear side to the front side. The shutter 66 is attached to the collection path CL4 with the regulating portion 62 of the collection path CL4 disposed in the portion to be guided 68. Thus, the shutter 66 is supported such that the shutter 66 is movable along the collection path CL4 between a closed position illustrated in FIGS. 10B and 10C and an open position illustrated in FIG. 10A. At the closed position, the shutter 66 is in contact with the regulating portion 62 and closes the outlet 61. The shutter 66 is moved forward from the outlet 61 to the open position so as to open the outlet 61. A coil spring 69 that serves as an example of an urging member is disposed between the shutter 66 and the cleaner container CL2. The coil spring 69 is disposed on an outer circumference of the collection path CL4. The coil spring 69 urges the shutter 66 so as to allow the shutter 66 to be held at the closed position. The collection auger CL3 extends in both the cleaner container CL2 and the collection path CL4. A gear G7 is supported at a front end portion of the collection auger CL3.

Description of a Drive System of the Process Unit U2

Referring back to FIGS. 3, 4, and 6, a driven gear G11 and intermediate gears G12 to G14 are supported in the front portion of the process unit U2. The driven gear G11 and the intermediate gears G12 to G14 transmit drive to the gears G0 to G2, G6, and G7. The driven gear G11 and the intermediate gears G12 to G14 each serve as an example of a transmitting member. That is, the driven gear G11 is supported at a left front end of the developing roller Ga. The drive is transmitted from a drive source (not illustrated) supported by the printer body U1 to the driven gear G11 when the process unit U2 is attached to the printer body U1.

The driven gear G11 is engaged with the gear G0 of the developing sleeve 12. Referring to FIG. 6, the gear G0 of the developing sleeve 12 is engaged with the first intermediate gear G12. The first intermediate gear G12 is engaged with the gear G1 of the supply auger Gb. The gear G1 of the supply auger Gb is engaged with the gear G2 of the agitating auger Gc.

Furthermore, referring to FIG. 4, the gear G0 of the developing sleeve 12 is engaged with the gear G6 of the photosensitive body PR. The gear G6 of the photosensitive body PR is engaged with the second intermediate gear G13. The second intermediate gear G13 is engaged with the third intermediate gear G14. The third intermediate gear G14 is engaged with the gear G7 of the collection auger CL3.

When the driven gear G11 is rotated by receiving the drive, the drive is transmitted to the gears G0 to G13 so as to rotate the gears G0 to G13.

Description of the Toner Cartridge TC and the Toner Replenishing Device TH1

Referring to FIG. 3, the toner cartridge TC according to the first exemplary embodiment includes the cylindrical cartridge body TC1 that extends in the front-rear direction. The handle TC1*a* is formed at a front end portion of the cartridge body TC1. The toner cartridge TC is supported by an attachment 71 of the toner replenishing device TH1 supported by the printer body U1 such that the toner cartridge TC is detachably attached to the attachment 71 of the toner replenishing device TH1. When the toner cartridge TC is attached to the attachment 71, a shutter (not illustrated) of the toner cartridge TC is moved so as to open a discharge port TC3. The toner transport member TC2 in the toner cartridge TC is rotated, and accordingly, new toner is supplied to the toner replenishing device TH1 through the discharge port TC3. Known related-art structures may be applied to the structure for attachment and detachment of the toner cartridge TC and the structure for supplying new toner from the toner cartridge TC. Thus, detailed description of the toner cartridge TC and the toner replenishing device TH1 is omitted.

Detailed Description of the Toner Transport Device TH2

Figure 11:
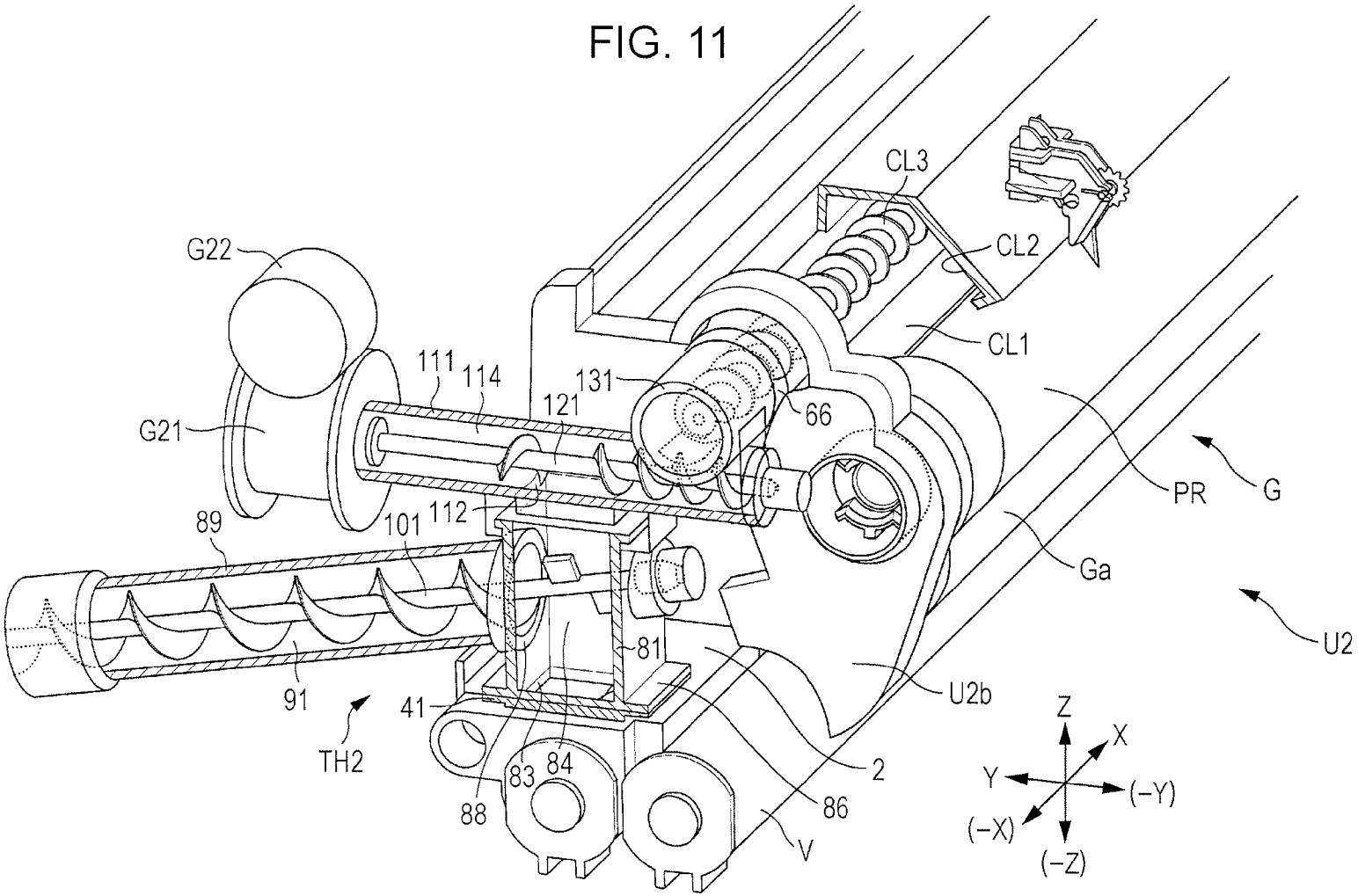
FIG. 11 is a sectional view of part of a toner transport device seen from the rear left.

FIG. 11 is a sectional view of part of the toner transport device seen from the rear left.

Figure 12:
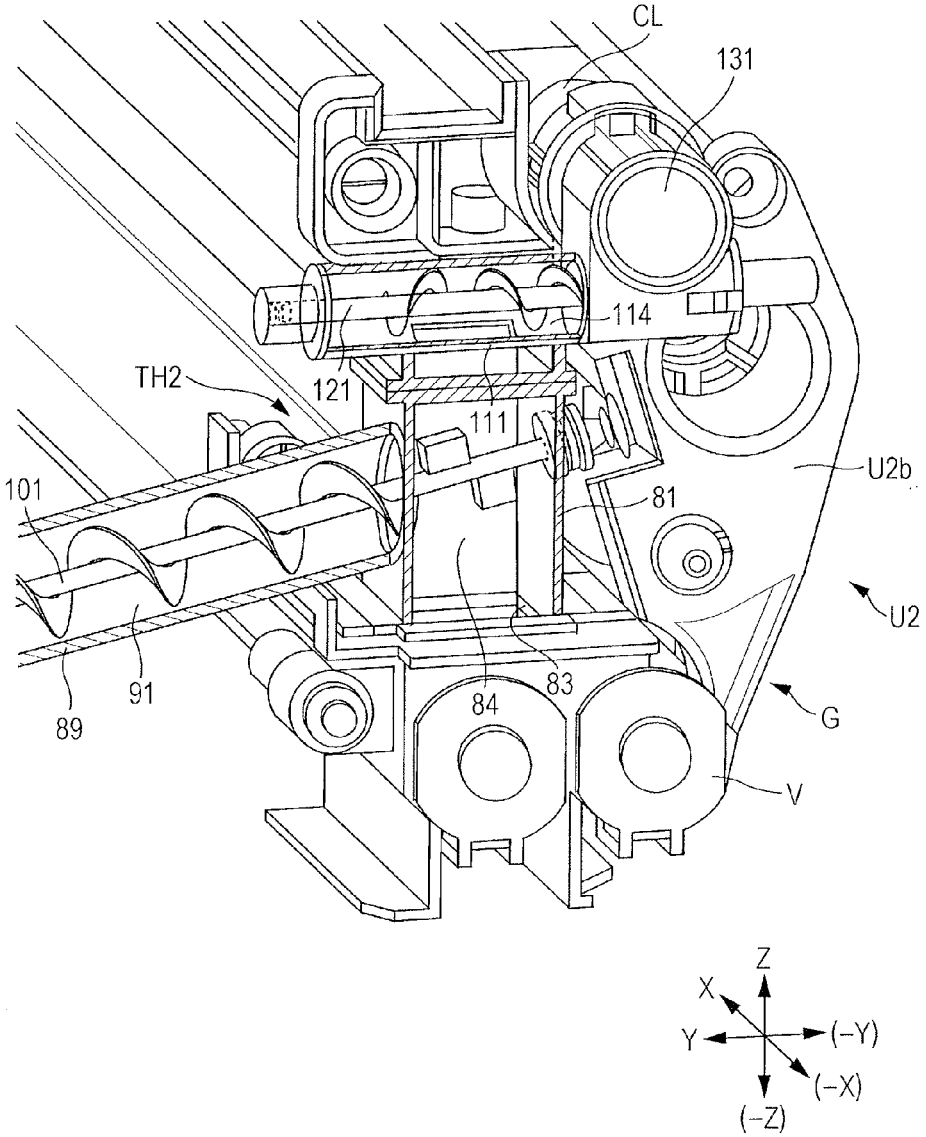
FIG. 12 is a sectional view of part of the toner transport device seen from the rear right.

FIG. 12 is a sectional view of part of the toner transport device seen from the rear right.

Figure 13A:
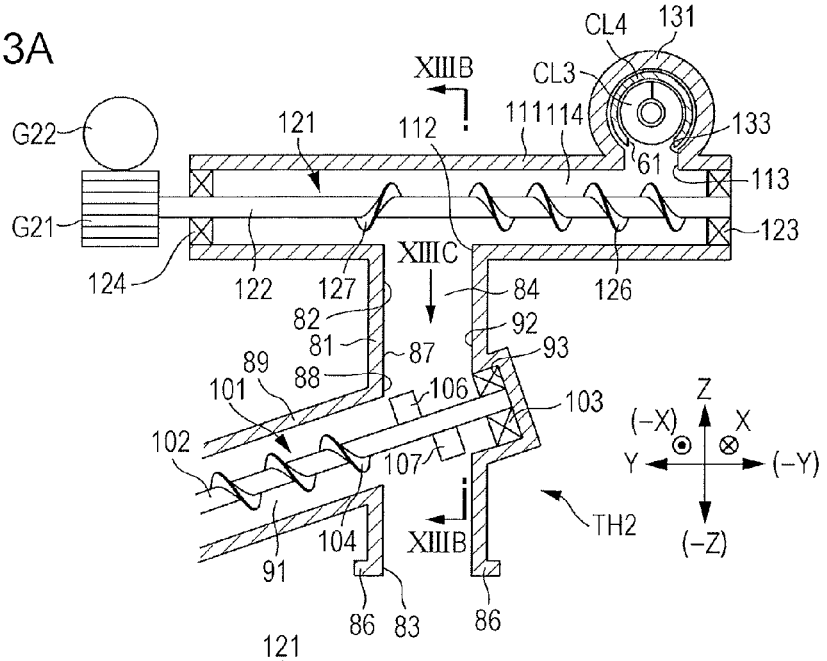
FIGS. 13A to 13C are explanatory views of the toner transport device, and out of the FIGS. 13A to 13C.
Figure 13B:
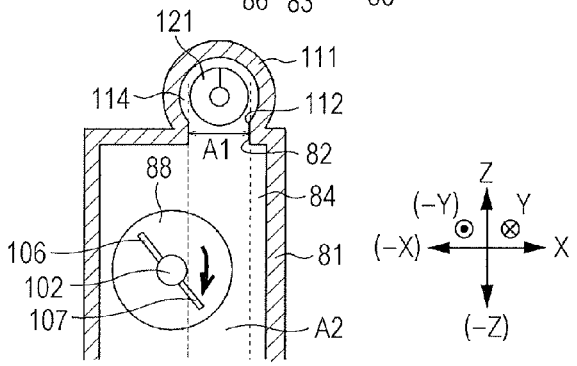
Figure 13C:
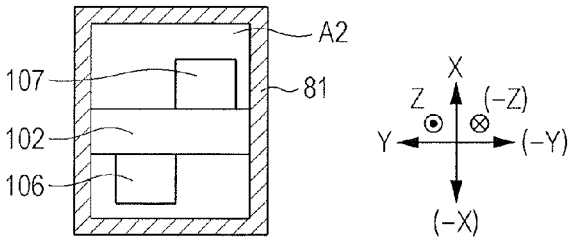

FIGS. 13A to 13C are explanatory views of the toner transport device. FIG. 13A is a sectional view of the transport path, FIG. 13B is a sectional view taken along line XIIIB-XIIIB illustrated in FIG. 13A, and FIG. 13C is a view seen in an arrow XIIIC direction illustrated in FIG. 13A.

Referring to FIGS. 4 and 11 to 13C, the toner transport device TH2 that serves as an example of a developer transport device is supported to the left of the toner replenishing device TH1. The toner transport device TH2 includes a falling portion 81. The falling portion 81 has an elongated hollow box shape that extends in the direction of the gravity.

The falling portion 81 has an opening 82 at an upper end thereof. The falling portion 81 also has an opening 83 at a lower end thereof. According to the first exemplary embodiment, a falling path 84 that serves as an example of a first sub-channel is defined by a space that is formed in the falling portion 81 and that extends in the direction of the gravity. Guide portions 86 are formed on the left and right sides of the opening 83 at the lower end of the falling portion 81. The guide portions 86 each serve as an example of a guide portion. The guide portions 86 project outward from the elongated hollow box and extend in the front-rear direction. An opening 88 is formed in a right wall 87 of the falling portion 81. The opening 88 penetrates through the right wall 87. An inclined transport unit 89 that extends from the toner replenishing device TH1 is connected to the opening 88 on the right side. The inclined transport unit 89 has a cylindrical shape that extends in an inclined direction from the lower right to the upper left. According to the first exemplary embodiment, an inclined transport path 91 that serves as an example of a second sub-channel and that is merged with the falling path 84 is defined by a space that is formed in the inclined transport unit 89 and that extends in the inclined direction. A bearing support 93 is formed in a left wall 92 corresponding to a position along a direction in which the inclined transport unit 89 upwardly extends. The bearing support 93 has a concave shape.

An inclined auger 101 that serves as an example of a transport member of the second sub-channel is disposed in the inclined transport path 91. The inclined auger 101 includes a rotational shaft 102 that extends along the inclined transport unit 89. The rotational shaft 102 extends from the inclined transport path 91 to the falling path 84 and intersects the falling path 84. The rotational shaft 102 is rotatably supported at both ends of the shaft. That is, the lower right end of the rotational shaft 102 is rotatably supported by a bearing (not illustrated) at an upstream end of the inclined transport unit 89. The rotational shaft 102 receives drive from the toner replenishing device TH1 at the lower right end. Furthermore, the upper left end of the rotational shaft 102 is rotatably supported by a bearing 103 supported by the bearing support 93. A transport blade 104 that is supported in a helical shape is supported on the rotational shaft 102. The transport blade 104 is formed so as to correspond to the position of the inclined transport unit 89. That is, the transport blade 104 is disposed in a region from the upstream end of the inclined transport unit 89 to the opening 88 of the falling portion 81.

Plural crumbling parts 106 and 107 are supported at parts of the rotational shaft 102 inside the falling path 84. The crumbling parts 106 and 107 are each formed to have a plate shape that extends from the rotational shaft 102 in the radial and axial directions. Here, the plural crumbling parts 106 and 107 are supported at positions shifted from each other in the axial direction. Also, the phases in the rotational direction of the plural crumbling parts 106 and 107 are shifted from each other. According to the first exemplary embodiment, the second crumbling part 107 is supported at a position shifted from the first crumbling part 106 in the axial direction of the rotational shaft 102. Also, the second crumbling part 107 is 180-degree out of phase with the first crumbling part 106 in the rotational direction of the rotational shaft 102. According to the first exemplary embodiment, the rotational direction of the rotational shaft 102 is set such that the crumbling parts 106 and 107 are moved downward when the crumbling parts 106 and 107 are moved on the front side of the rotational shaft 102, and the crumbling parts 106 and 107 are moved upward when the crumbling parts 106 and 107 are moved on the rear side of the rotational shaft 102. At this time, the transport blade 104 transports the toner from a lower right portion to an upper left portion in the inclined transport path 91.

An upstream transport unit 111 is connected to the opening 82 at the upper end of the falling portion 81. The upstream transport unit 111 has a cylindrical shape that extends in the left-right direction. Referring to FIGS. 13B and 13C, the upstream transport unit 111 is disposed at a position shifted from the rotational shaft 102 of the inclined auger 101 when seen from above in the direction of the gravity. According to the first exemplary embodiment, the upstream transport unit 111 is shifted forward from the rotational shaft 102. The upstream transport unit 111 has an outlet 112. The outlet 112 is connected to the opening 82. Thus, referring to FIGS. 13B and 13C, an inlet A1 of the falling path 84 according to the first exemplary embodiment is defined by a connecting portion where the opening 82 and the outlet 112 are connected to each other. In particular, a toner falling region A2 is set in a region below the inlet A1 in the direction of the gravity. An inlet 113 is formed to the left of the outlet 112, that is, at a left end of the upstream transport unit 111. The inlet 113 is open at the top. According to the first exemplary embodiment, an upstream transport path 114 that serves as an example of a third sub-channel is defined by a space that is formed in the upstream transport unit 111 and that extends in the left-right direction.

A merged path 84+91+114 that serves as an example of the channel according to the first exemplary embodiment is defined by the falling path 84, the inclined transport path 91, and the upstream transport path 114.

An upstream auger 121 that serves as an example of a third-channel transport member is disposed in the upstream transport path 114. The upstream auger 121 includes a rotational shaft 122 that extends along the upstream transport unit 111. The rotational shaft 122 is rotatably supported by bearings 123 and 124 at the left and right ends of the upstream transport unit 111. A gear G21 is supported at a right end portion of the rotational shaft 122. The gear G21 receives the drive from a gear G22. The gear G22 is rotated by receiving the drive from a drive source (not illustrated). A helically wound transport blade 126 is supported on the rotational shaft 122. The transport blade 126 is disposed in a region from the left end of the upstream transport unit 111 to the outlet 112. Also, a reverse transport blade 127 wound in a direction opposite to that of the transport blade 126 is supported on the rotational shaft 122 corresponding to the position of a right portion of the outlet 112. According to the first exemplary embodiment, the rotational direction of the upstream auger 121 and the winding directions of the transport blades 126 and 127 are set so that, when the upstream auger 121 is rotated, the toner is transported from the inlet 113 toward the outlet 112.

Referring to FIGS. 10A to 13C, an insertion portion 131 that serves as an example of a connecting portion is formed above the left end of the upstream transport unit 111. The insertion portion 131 has a cylindrical shape that extends in the front-rear direction. An inner diameter of the insertion portion 131 is greater than an outer diameter of the collection path CL4 the photosensitive-body cleaner CL and smaller than the flange portion 67 of the shutter 66 of the collection path CL4. Referring to FIGS. 10A to 10B, a shutter pressing portion 132 that serves as an example of an engagement with an opening and closing member is formed at a front end of the insertion portion 131. The insertion portion 131 has an opening 133 connected to the inlet 113 of the upstream transport unit 111.

Referring to FIGS. 9A to 9D, a shutter 141 that serves as an example of a falling-path opening and closing member is supported at the guide portions 86 of the falling portion 81. The shutter 141 has a structure similar to or the same as that of the shutter 51 of the developing container V. That is, the shutter 141 includes a body portion 142, a spring support portion 143, and portions to be guided 144 and 146. The portions to be guided 144 and 146 are guided while being engaged with the guide portions 86. Thus, the shutter 141 according to the first exemplary embodiment is supported such that the shutter 141 is movable between a closed position illustrated in FIG. 9B and an open position illustrated in FIG. 9A. The shutter 141 at the closed position closes the opening 83 of the falling portion 81. The shutter 141 is moved rearward from the opening 83 to the open position so as to open the opening 83. A seal 147 is supported on an upper surface of the body portion 142 of the shutter 141. The seal 147 tightly closes a gap between the shutter 141 and the opening 83 of the falling portion 81. A spring 148 is supported between the spring support portion 143 of the shutter 141 and a spring support portion U1*a* provided on the printer body U1. The spring 148 urges the shutter 141 forward. That is, the spring 148 urges the shutter 141 so as to hold the shutter 141 at the closed position.

Operations of the Process Unit U2, the Toner Cartridge TC, the Toner Replenishing Device TH1, and the Toner Transport Device TH2

When an image forming operation is performed with the printer U according to the first exemplary embodiment having the above-described structure, the developing device G of the process unit U2 develops an electrostatic latent image on the photosensitive body PR with toner. The toner on the photosensitive body PR is transferred onto the sheet S that serves as an example of a transfer medium in the transfer region Q3. The toner that has not been transferred and remains on the photosensitive body PR is removed from the photosensitive body PR by the cleaning blade CL1 of the photosensitive-body cleaner CL. The toner having been removed is collected in the cleaner container CL2 and transported by the collection auger CL3. Thus, the toner having been collected, that is, so-called collected toner is transported through the collection path CL4, flows out through the outlet 61 of the collection path CL4, and flows into the inlet 113 of the upstream transport path 114.

The collected toner in the upstream transport path 114 is transported by the transport blade 126 of the upstream auger 121 toward the outlet 112. The collected toner having reached the outlet 112 flows out downward through the outlet 112. In so doing, the reverse transport blade 127 returns part of the toner having passed through the outlet 112 back to the outlet 112. The toner having flowed out into the falling path 84 through the outlet 112 falls through the falling path 84 by its own weight. The toner that falls through the falling path 84 passes through the lower opening 83 and the replenishing port 42 of the developing container V and flows into the agitating chamber 7 of the developing container V. Thus, the collected toner is returned to the developing container V of the developing device G.

Furthermore, new toner is supplied from the toner cartridge TC attached to the toner replenishing device TH1 in accordance with the amount of toner consumed by the developing device G. In the toner cartridge TC, the tone transport member TC2 is rotated in accordance with the toner consumption amount, so that the new toner in the cartridge body TC1 is transported to the discharge port TC3. The new toner discharged through the discharge port TC3, that is, so-called new toner is transported to the toner replenishing device TH1 and transported to a lower right end of the inclined transport path 91. The inclined auger 101 is rotated in the inclined transport path 91, so that the new toner is transported to the upper left portion of the inclined transport path 91 by the transport blade 104. This causes the new toner to flow into the falling path 84 through the opening 88 and to fall through the falling path 84 by its own weight. Consequently, similarly to the collected toner, the new toner also passes through the lower opening 83 and the replenishing port 42 of the developing container V and flows into the agitating chamber 7 of the developing container V. Thus, the new toner is supplied to the developing container V of the developing device G.

Furthermore, according to the first exemplary embodiment, the new toner is transported through the inclined transport path 91 that is inclined upward toward the downstream side. Thus, the new toner may be likely to be transported in a state in which the new toner is contained between the turns of the transport blade 104. Here, with a transport path that is inclined downward toward the downstream side, developer may tend to be moved by its own weight. Thus, the developer may flow out even when the transport member is driven.

In particular, according to the first exemplary embodiment, the collected toner flows into the falling path 84 through the inlet A1. Thus, the collected toner may tend to fall freely through the falling region A2 set directly below the inlet A1. That is, the collected toner may tend to pass through a region further to the front than the rotational shaft 102 that intersects the falling path 84. Thus, according to the first exemplary embodiment, the collected toner may be unlikely to be brought into contact with the rotational shaft 102 even with the structure in which both the ends of the rotational shaft 102 are supported. That is, the rotational shaft 102 does not necessarily close the falling region A2, and accordingly, falling of the toner may be unlikely to be blocked by the rotational shaft 102.

Furthermore, the rotational shaft 102 according to the first exemplary embodiment has the crumbling parts 106 and 107 corresponding to the falling region A2. The crumbling parts 106 and 107 crumble the toner. The positions in the axial direction and the phases of the crumbling parts 106 and 107 according to the first exemplary embodiment are shifted from each other. Thus, even when one of the crumbling parts 106 and 107 closes the falling region A2, the other one of the crumbling parts 106 and 107 does not necessarily close the falling region A2. Accordingly, compared to the structure in which, for example, a single plate-shaped member is used to crumble the toner in the entirety of the falling region A2, the falling region A2 may be unlikely to be closed.

Here, according to the first exemplary embodiment, the falling path 84 and the inclined transport path 91 that extends upward in the inclined direction are merged with each other. Thus, the speed at which the new toner that flows from the inclined transport path 91 into the falling path 84 falls is substantially zero. In this state, when the collected toner falls from above, the speed at which the collected toner falls may be reduced by contact of the collected toner with an upper portion of the new toner. Thus, the collected toner may be attracted to and remain on the wall surface. In order to address this, according to the first exemplary embodiment, the crumbling parts 106 and 107 are provided at part of the rotational shaft 102 extending in the falling path 84. Thus, even when the toner is attracted to the wall surface, the toner may be crumbled by the crumbling parts 106 and 107.

Accordingly, compared to the case where the crumbling parts 106 and 107 are not provided, clogging of the falling path 84 due to the toner may be unlikely to occur.

Furthermore, the crumbling parts 106 and 107 according to the first exemplary embodiment are moved downward in the falling region A2. Thus, compared to the case where the crumbling parts 106 and 107 are moved upward in the falling region A2, the toner may be unlikely to be scooped upward. Furthermore, the toner is pressed downward and may tend to be transported to the downstream side in the falling region A2. Accordingly, the clogging of the falling region A2 due to the toner may be unlikely to occur according to the first exemplary embodiment.

The crumbling parts 106 and 107 are integrally formed with the inclined auger 101. Thus, compared to the case where a dedicated crumbling member is disposed in addition to the transport member, the number of components may be reduced.

Accordingly, with the toner transport device TH2 according to the first exemplary embodiment, the collected toner and the new toner may be mixed with each other and are transported in a state in which clogging is unlikely to occur. The toner having been transported by the toner transport device TH2 falls through the replenishing port 42 of the developing container V and flows into the developing device G. That is, the collected toner and the new toner flow into an upstream end of the agitating chamber 7.

The toner is transported toward the front connecting portion 8*b* while being agitated by the double-helix transport blade Gc2 in the agitating chamber 7. The toner that has reached the front connecting portion 8*b* is accumulated by the double-helix transport blade Gc2 and the reverse transport blade Gc3 and flows into the supply chamber 6 through the front connecting portion 8*b*. Here, the filter 31 is disposed in the front connecting portion 8*b* so as to trap foreign matter in the toner that passes therethrough. Examples of the foreign matter include paper dust and other dust contained in the collected toner. Furthermore, the double-helix transport blade Gb2 of the supply auger Gb transports the toner in the supply chamber 6. Thus, the toner is attracted to the developing roller Ga for, for example, use in development. The toner having been transported to a downstream end of the supply chamber 6 passes through the rear connecting portion 8*a*. The toner flows into the upstream end of the agitating chamber 7 and is mixed with the collected toner and the new toner that fall. The mixed toner is circulated in the circulating chamber 6+7 of the developing container V.

According to the first exemplary embodiment, the toner replenishing device TH1 and the toner transport device TH2 are supported by the printer body U1. The process unit U2 and the toner cartridge TC are attached to and detached from the printer body U1. That is, referring to FIGS. 9A to 10C, in order to detach the process unit U2, the handle U2*a*1 is held and the process unit U2 is detached forward from the printer body U1. At this time, the shutter 51 of the developing container V and the shutter 66 of the photosensitive body cleaner CL of the process unit U2 are separated from the toner transport device TH2. Also, the shutter 141 for the falling portion 81 of the toner transport device TH2 is separated from the developing container V. Thus, the shutters 51, 66, and 141 are moved from the respective open positions to the respective closed positions by urging forces applied by the springs 58, 69, and 148. Thus, when the process unit U2 is detached, the replenishing port 42, the outlet 61, and the opening 83 are closed. In contrast, when the process unit U2 is attached, the process unit U2 is pressed rearward to be attached to the printer body U1. At this time, the shutters 51 and 66 of the process unit U2 are brought into contact with the toner transport device TH2 and movements of the shutters 51 and 66 are blocked. This causes the shutters 51 and 66 to be relatively moved to the respective open positions against the urging forces applied by the springs 58 and 69. Also, the shutter 141 of the toner transport device TH2 is brought into contact with the developing container V and pressed. This causes the shutter 141 to be moved to the open position against the urging force of the spring 148. Consequently, the outlet 61 of the photosensitive body cleaner CL and the inlet 113 of the toner transport device TH2 are connected to each other, thereby connecting the replenishing port 42 of the developing container V and the opening 83 of the falling portion 81 to each other.

Second Exemplary Embodiment

Next, a second exemplary embodiment of the present invention will be described. In this description of the second exemplary embodiment, elements corresponding to those of the first exemplary embodiment are denoted by the same reference signs and detailed description thereof is omitted.

Although the second exemplary embodiment is different from the first exemplary embodiment in the following points, the second exemplary embodiment has a structure that is the same as or similar to that of the first exemplary embodiment in other points.

Figure 14:
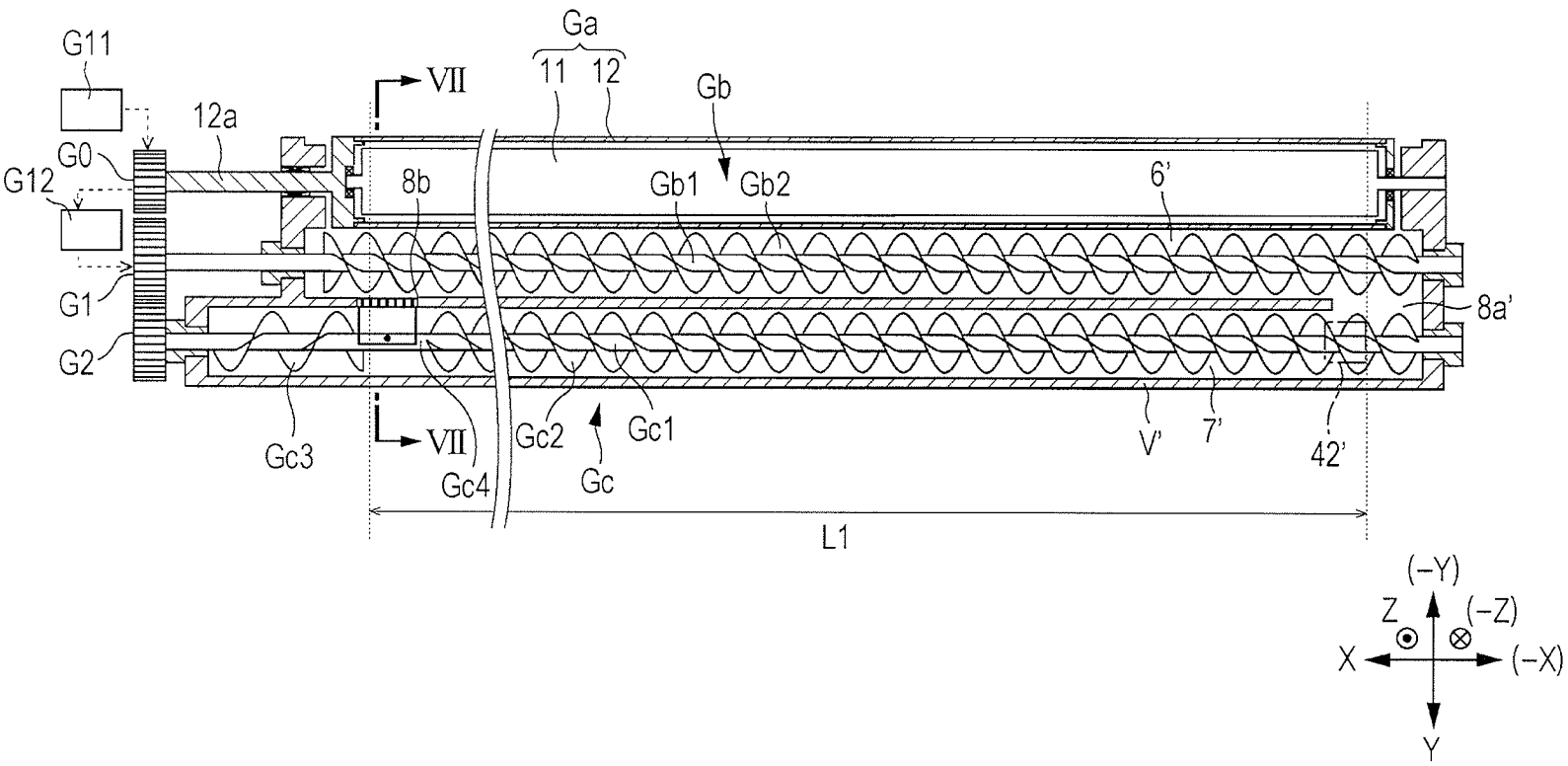
FIG. 14 is an explanatory view of a developing device according to a second exemplary embodiment corresponding to FIG. 6 of the first exemplary embodiment.

FIG. 14 is an explanatory view of a developing device according to the second exemplary embodiment corresponding to FIG. 6 of the first exemplary embodiment.

Referring to FIG. 14, the projection 3 provided in the developing container V according to the first exemplary embodiment is omitted from a developing container V' according to the second exemplary embodiment. That is, the lengths of a supply chamber 6' and an agitating chamber 7' in the front-rear direction of the developing container V' according to the second exemplary embodiment correspond to that of the developing roller chamber 4. Also, a rear connecting portion 8*a*' is formed between a downstream end of the supply chamber 6' and an upstream end of the agitating chamber 7'. Furthermore, a replenishing port 42' is formed in a container covering 2' corresponding to the upstream end of the agitating chamber 7'. According to the second exemplary embodiment, the position of the replenishing port 42' in the axial direction is superposed with an end portion of a maximum developing region L1 set in the developing roller Ga.

Operations of the Process Unit U2, the Toner Cartridge TC, the Toner Replenishing Device TH1, and the Toner Transport Device TH2

In the printer U that includes the above-described structure, the toner is supplied to the developing device G through the toner transport device TH2. Thus, similarly to or the same as the first exemplary embodiment, the new toner and the collected toner are transported through the falling path 84 where the new toner and the collected toner may be mixed with each other, and the new toner and the collected toner are supplied to the developing device G in a state in which clogging may be unlikely to occur.

Variations

Although the exemplary embodiments of the present invention have been described in detail, the present invention is not limited to the above-described exemplary embodiments. Many variations are possible without departing from the gist of the present invention described in the claims. Examples of variations (H01 to H05) of the present invention are described below.

H01: According to the above-described exemplary embodiments, the printer U is described as the example of the image forming apparatus. However, the image forming apparatus is not limited to the printer U. The image forming apparatus is applicable to any one of a copier, a facsimile machine, a multi-function machine that has plural functions of these machines, and so forth.

H02: According to the above-described exemplary embodiments, the falling path 84 that extends in the direction of the gravity is described as the example of the first sub-channel, and the inclined transport path 91 that is merged with the falling path 84 is described as the example of the second sub-channel. However, the first and second sub-channels are not limited to these. For example, the following structure is possible: the first sub-channel is an inclined transport path or a horizontally extending transport path, and the second sub-channel is merged with the first sub-channel.

H03: According to the above-described exemplary embodiments, the example is described in which the collected toner flows into the falling path 84 from above and the new toner flows into the falling path 84 from the side of the falling path 84. However, the directions in which the collected toner and the new toner flow are not limited to these and the following structure is possible: the new toner flows from above and the collected toner flows form the side.

H04: According to the above-described exemplary embodiments, the example is described in which the inclined auger 101 includes the plate-shaped crumbling parts 106 and 107. However, the shape of the crumbling parts is not limited to this. The crumbling parts may have any shape such as a bar shape or a convex shape. Furthermore, the number of the crumbling parts 106 and 107 is not limited to two. The inclined auger 101 may include a single crumbling part or three or more crumbling parts.

H05: According to the above-described exemplary embodiments, although the crumbling parts 106 and 107 may be provided on the inclined auger 101, the crumbling parts 106 and 107 may be omitted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding body that includes a surface on which a latent image may be formed;

a developing device configured to develop the latent image into a visual image with developer;

a transfer device configured to transfer the visual image onto a transfer medium;

a collection device configured to collect the developer remaining on the surface of the image holding body after the visual image has been transferred;

a container configured to contain new developer to be supplied to the developing device; and a transport member that includes:

a shaft; and a transport blade supported by the shaft, wherein the transport blade has a helical shape, wherein the image forming apparatus comprises a channel that comprises a first sub-channel connected to the developing device and a second sub-channel merged with the first sub-channel, wherein the image forming apparatus is configured such that the developer flows into the first sub-channel from one of the collection device and the container, and the developer flows into the second sub-channel from the other of the collection device and the container, wherein the transport member is disposed in the second sub-channel so as to transport the developer, and part of the transport member extends into the first sub-channel, wherein the first sub-channel comprises an inlet portion through which the developer flows into the first sub-channel from the one of the collection device and the container, wherein the second sub-channel comprises an outlet portion through which the developer flows out of the second sub-channel and into the first sub-channel, and wherein the inlet portion of the first sub-channel is positioned above the outlet portion of the second sub-channel.

2. The image forming apparatus according to claim 1, wherein the first sub-channel extends in a direction of gravity, so that the developer falls through the first sub-channel.

3. The image forming apparatus according to claim 2, further comprising:

at least one crumbling part that is supported by the shaft in the first sub-channel and that is configured to crumble the developer flowing through the first sub-channel.

4. The image forming apparatus according to claim 3, wherein the at least one crumbing part comprises a plurality of crumbing parts, wherein the plurality of crumbling parts are supported by the shaft at positions shifted from one another in an axial direction, and wherein phases in a rotational direction of the plurality of crumbling parts are shifted from one another.

5. The image forming apparatus according to claim 3, wherein the second sub-channel comprises a downstream end, wherein the inlet portion through which the developer flows is provided in the first sub-channel at a position above the downstream end of the second sub-channel in the direction of the gravity such that the position of the inlet portion is shifted from the shaft when seen from above in the direction of the gravity, and wherein the at least one crumbling part of the shaft is configured to be rotated in a direction toward a lower side on a side close to the inlet portion when seen from above in the direction of the gravity.

6. The image forming apparatus according to claim 1, wherein the shaft comprises a first end and a second end, and wherein the transport member of the second sub-channel is supported at the first end and the second end of the shaft.

7. The image forming apparatus according to claim 1, wherein the developing device includes:

a developer holding body that faces the image holding body and that is configured to hold the developer;

a first container chamber that is disposed along the developer holding body and that is configured to contain the developer to be supplied to the developer holding body, and a second container chamber that comprises an upstream portion in a transport direction in which the developer is transported, that is disposed side-by-side with the first container chamber, and that is configured to contain the developer circulated through the first container chamber and the second container chamber, wherein the channel comprises a downstream end, and wherein the downstream end of the channel is connected to the upstream portion of the second container chamber in the transport direction.

8. The image forming apparatus according to claim 1, wherein the image forming apparatus is configured such that developer collected by the collection device flows into the first sub-channel, and wherein the second sub-channel is inclined upward toward the first sub-channel, and the image forming apparatus is configured such that the new developer supplied from the container flows into the second sub-channel.

9. An image forming apparatus comprising:

an image holding body that includes a surface on which a latent image may be formed;

a developing device configured to develop the latent image into a visual image with developer;

a transfer device configured to transfer the visual image onto a transfer medium;

a collection device configured to collect the developer remaining on the surface of the image holding body after the visual image has been transferred;

a container configured to contain new developer to be supplied to the developing device; and a transport member that includes:

a shaft; and a transport blade supported by the shaft, wherein the transport blade has a helical shape, wherein the image forming apparatus comprises a channel that comprises a first sub-channel connected to the developing device and a second sub-channel merged with the first sub-channel, wherein image forming apparatus is configured such that the developer flows into the first sub-channel from one of the collection device and the container, and the developer flows into the second sub-channel from the other of the collection device and the container, wherein the transport member is disposed in the second sub-channel so as to transport the developer, and part of the transport member extends into the first sub-channel, and wherein the image forming apparatus further comprises at least one crumbling part that is supported by the shaft in the first sub-channel and that is configured to crumble the developer flowing through the first sub-channel.

10. The image forming apparatus according to claim 9, wherein the at least one crumbing part comprises a plurality of crumbing parts, wherein the plurality of crumbling parts are supported by the shaft at positions shifted from one another in an axial direction, and wherein phases in a rotational direction of the plurality of crumbling parts are shifted from one another.

11. The image forming apparatus according to claim 9, wherein the second sub-channel comprises a downstream end, wherein an inlet portion through which the developer flows is provided in the first sub-channel at a position above the downstream end of the second sub-channel in a direction of gravity such that the position of the inlet portion is shifted from the shaft when seen from above in the direction of the gravity, and wherein the at least one crumbling part of the shaft is configured to be rotated in a direction toward a lower side on a side close to the inlet portion when seen from above in the direction of the gravity.

* * * * *